US009051119B2

(12) United States Patent
Jarrett et al.

(10) Patent No.: US 9,051,119 B2
(45) Date of Patent: Jun. 9, 2015

(54) BAG RETENTION SYSTEM AND FIELD CONFIGURABLE WASTE AND RECYCLING RECEPTACLES AND SYSTEMS EMPLOYING SAME

(75) Inventors: David Robert Jarrett, Stouffville (CA); Jeffrey William Thrasher, Keswick (CA); Rod Muir, South Mountain (CA); Torrin Mullins, Ottawa (CA); Mike Sirois, Ottawa (CA); Phil Streets, Ottawa (CA)

(73) Assignee: Midpoint International Inc., Aurora (CA)

( * ) Notice: Subject to any disclaimer, the term of this patent is extended or adjusted under 35 U.S.C. 154(b) by 52 days.

(21) Appl. No.: 13/991,263

(22) PCT Filed: Dec. 5, 2011

(86) PCT No.: PCT/CA2011/001330

§ 371 (c)(1),
(2), (4) Date: Aug. 16, 2013

(87) PCT Pub. No.: WO2012/071660

PCT Pub. Date: Jun. 7, 2012

(65) Prior Publication Data

US 2014/0291328 A1 Oct. 2, 2014

Related U.S. Application Data

(60) Provisional application No. 61/419,479, filed on Dec. 3, 2010.

(51) Int. Cl.
*B65D 90/00* (2006.01)
*B65F 1/14* (2006.01)
(Continued)

(52) U.S. Cl.
CPC ..... *B65F 1/14* (2013.01); *B65F 1/0046* (2013.01); *B65F 1/02* (2013.01); *B65F 1/067* (2013.01); *B65F 1/1426* (2013.01); *B65F 1/1607* (2013.01); *B65F 2210/1121* (2013.01)

(58) Field of Classification Search
CPC ..... B65F 1/14; B65F 1/067; B65F 1/1426; B65F 1/06; B65F 1/04
USPC ..... 220/495, 495.07–495.09, 495.1
See application file for complete search history.

(56) References Cited

U.S. PATENT DOCUMENTS 3,656,650 A 4/1972 Frater
3,720,346 A 3/1973 Cypher
(Continued)

FOREIGN PATENT DOCUMENTS

JP 2006168985 A 6/2006

OTHER PUBLICATIONS

International Preliminary Report on Patentability dated Jun. 4, 2013 relating to PCT International Application No. PCT/CA2011/001330.

*Primary Examiner* — Anthony Stashick
*Assistant Examiner* — Raven Collins
(74) *Attorney, Agent, or Firm* — Perry + Currier Inc.; Dolly Kao

(57) ABSTRACT

A bag retention system and field configurable waste and recycling receptacle and receptacle systems that employ same. The bag retention system includes a peripheral side wall element having an upper portion defining an opening for receiving at least one bag, the peripheral side wall element having a bag opening and support member (e.g. an outwardly extending flange) about which an upper portion of a bag can be wrapped, and a tensioning element located below the flange and coupled to and extending outwardly from the side wall element, the tensioning element having means for releasably securing excess material from an upper portion of a bag, whereby a bag can be inserted in the opening with an upper portion thereof folded over and tightened around flange by pulling the upper portion of the bag taut around the flange and releasably securing the excess material to the tensioning element.

27 Claims, 23 Drawing Sheets

(51) Int. Cl.

| | |
|---|---|
| ***B65F 1/00*** | (2006.01) |
| ***B65F 1/02*** | (2006.01) |
| ***B65F 1/06*** | (2006.01) |

(56) References Cited

U.S. PATENT DOCUMENTS

| | | | | | |
|---|---|---|---|---|---|
| 4,867,328 | A | | 9/1989 | McCarthy | |
| 4,878,592 | A | | 11/1989 | Lee | |
| 4,964,523 | A | | 10/1990 | Bieltvedt et al. | |
| 4,974,746 | A | * | 12/1990 | Dickinson | 220/495.09 |
| 5,033,641 | A | | 7/1991 | Martin | |
| 5,050,768 | A | | 9/1991 | Alden | |
| 5,072,852 | A | * | 12/1991 | Smith et al. | 220/495.09 |
| 5,078,297 | A | | 1/1992 | Howard et al. | |
| 5,082,139 | A | | 1/1992 | Quam | |
| 5,103,998 | A | | 4/1992 | Caro et al. | |
| 5,111,958 | A | | 5/1992 | Witthoeft | |
| 5,143,246 | A | | 9/1992 | Johnson et al. | |
| 5,150,809 | A | | 9/1992 | Leigh | |
| 5,167,343 | A | | 12/1992 | Winfrey et al. | |
| 5,289,941 | A | | 3/1994 | Blankenburg et al. | |
| 5,398,838 | A | | 3/1995 | Dosunmu | |
| 5,417,338 | A | | 5/1995 | Roy et al. | |
| 5,558,254 | A | * | 9/1996 | Anderson et al. | 220/527 |
| 5,615,797 | A | | 4/1997 | Ripamonti | |
| 5,662,235 | A | | 9/1997 | Nieto | |
| 5,873,643 | A | | 2/1999 | Burgess, Jr. et al. | |
| 6,193,091 | B1 | | 2/2001 | Olivetti | |
| 6,241,115 | B1 | | 6/2001 | Delmerico et al. | |
| 6,913,386 | B2 | * | 7/2005 | Maher et al. | 383/38 |
| 7,464,829 | B1 | | 12/2008 | Koefelda et al. | |
| 7,624,915 | B2 | | 12/2009 | Dembowiak et al. | |
| 2008/0302801 | A1 | | 12/2008 | Barrett et al. | |

* cited by examiner

DETAIL A
SCALE 1 : 5

DETAIL B
SCALE 1 : 5

DETAIL C
SCALE 1 : 1.2

DETAIL E
SCALE 1 : 1.2

DETAIL D
SCALE 1 : 1.2

DETAIL G
SCALE 1.5 : 1

DETAIL I

DETAIL H
SCALE 1 : 1

DETAIL
SCALE 1 : 2

DETAIL
SCALE 1 : 2

DETAIL
SCALE 1 : 2

DETAIL
SCALE 1 : 2

FIG 27
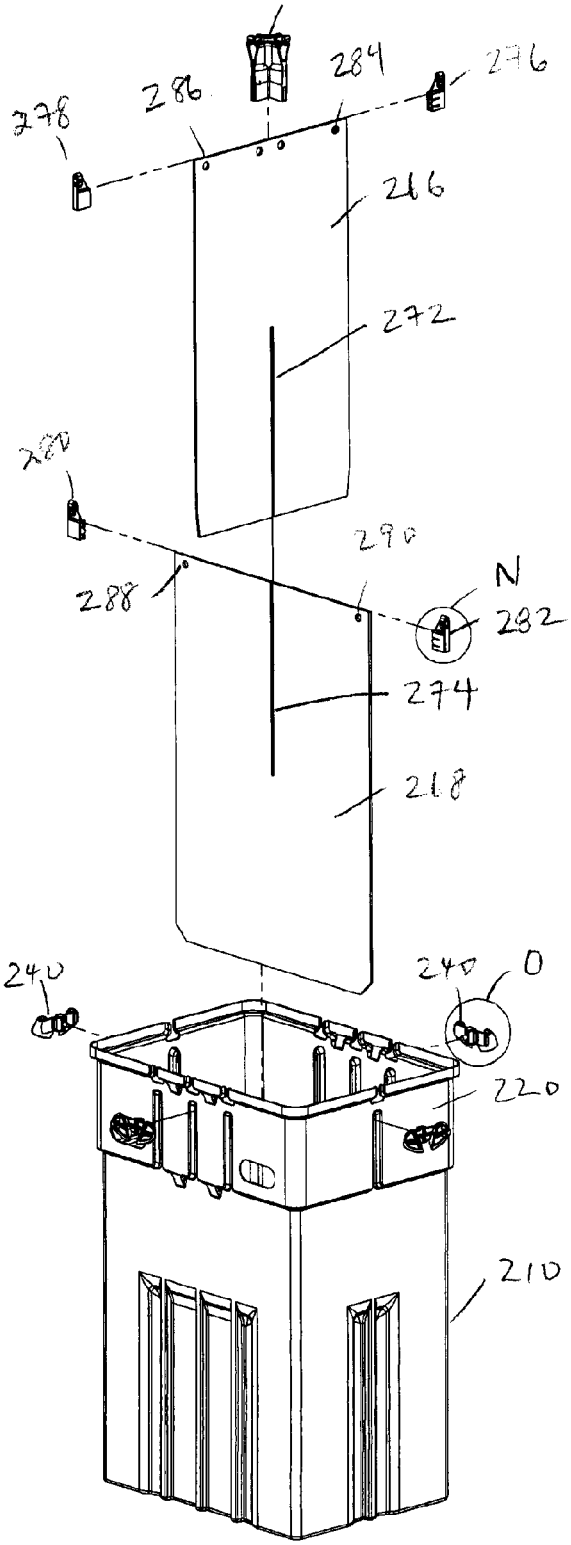
FIG. 28
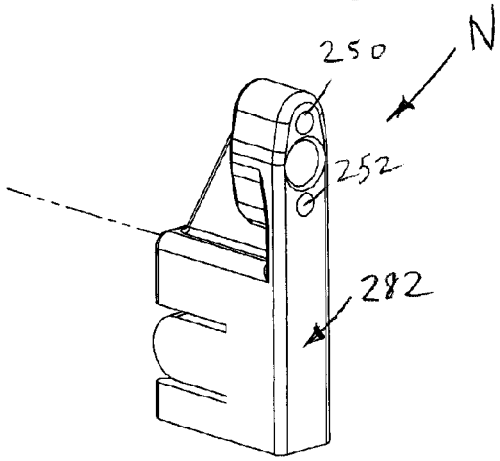
DETAIL
SCALE 1 : 1
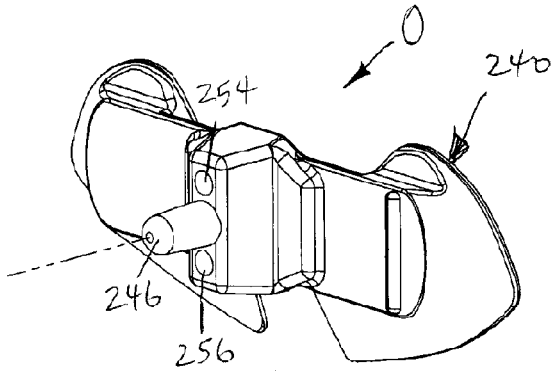
DETAIL
SCALE 1 : 1
FIG. 29

DETAIL
SCALE 1 : 2

DETAIL
SCALE 1 : 2

BAG RETENTION SYSTEM AND FIELD CONFIGURABLE WASTE AND RECYCLING RECEPTACLES AND SYSTEMS EMPLOYING SAME

This application claims the benefit under 35 U.S.C. 120 of U.S. provisional application 61/419,479 filed Dec. 3, 2011.

FIELD

The present invention relates to waste and recycling receptacles and receptacle systems for industrial, commercial or household use.

BACKGROUND

Waste and recycling receptacles and receptacle systems are used for on-site, temporary storage of waste and recycling. The term "recycling," when used herein, means any material that is discarded by a user and that can be processed for re-use where facilities exist, and includes, depending on the jurisdiction, compost or other organic waste, paper, glass, plastics, metal containers, and electronic waste (such as cell phones, batteries, computers). The term "waste," when used herein, means material that is discarded other than recycling, which material is normally is dumped in landfill or incinerated.

Throughout this specification, waste and garbage will be used interchangeably and are to be given the same meaning. It will be appreciated that what constitutes waste in one jurisdiction may be considered recycling in another jurisdiction where recycling facilities exist.

Given the widespread nature of recycling programs, it is desirable to provide receptacles having multiple compartments for separating waste from recycling and, if applicable, different types of recycling from each other (e.g. organic waste from paper). As recycling technologies evolve, it is envisioned that the amount of waste generated by users will decrease, while the amount of recycling will increase. It is therefore advantageous to provide a waste and recycling receptacle and system capable of handling changing volumes of each type of discarded matter to minimize time spent emptying receptacles and to eliminate the need to replace existing units with new different capacity units. It is also desirable to provide a receptacle system that can be configured on-site to provide a variable number of compartments based on user requirements.

Multiple-compartment receptacles are known and disclosed in U.S. Pat. Nos. 4,974,746, 5,033,641, 5,615,797, and 5,873,643. However, a need still exists for improved receptacles and receptacle systems that are easy to configure and reconfigure in the field due to changing needs and requirements, and which provides a means for securing a flexible bag in each compartment (particularly a bag without handles) without the risk of slippage and wherein the bag is retained around the entire opening of the compartment to maximize the opening to the bag.

SUMMARY

In accordance with a first aspect, the invention provides a bag retention system for retaining one or more bags used for the temporary on-site storage of discarded matter, the bag retention system comprising:

a. a peripheral side wall element having an upper portion defining an opening for receiving at least one bag, the peripheral side wall element having a bag opening and support member about which an upper portion of a bag can be wrapped, and b. a tensioning element located below the bag opening and support member and coupled to and extending outwardly from the side wall element, the tensioning element having means for releasably securing excess material from an upper portion of a bag, whereby a bag can be inserted in the opening with an upper portion thereof folded and pulled taut over the bag opening and support member by releasably securing the excess material to the tensioning element.

The tensioning element may be releasably coupled to the side wall element and comprise a wing or a pair of opposed wings spaced a selected distance from the side wall element to allow the excess bag material to be wrapped around the wing and held in place by friction.

The bag opening and support member may comprise at least one outwardly extending flange, which flange may be defined by the top portion of the peripheral side wall element. In some embodiments, the bag opening and support member comprises a plurality of flanges, spaced apart from one another wherein adjacent flanges define therebetween a downwardly extending slot in the top portion of the peripheral side wall element. The tensioning element may be located below the slot, whereby excess bag material can be guided through the slot and releasably secured to the tensioning element. The slot may widen from top to bottom such that the flanges on either side of the slot define a pair of opposed overhangs, whereby an upper portion of a bag can be wrapped over and maintained in a taut condition over at least one flange and a pair of overhangs.

The bag retention system may comprise at least one pair of said slots, the slots of each pair being located in the peripheral side wall element opposite to one another, and comprising at least tensioning element corresponding to each pair of said slots, each tensioning element being located below a respective slot in the corresponding pair of slots, whereby an upper portion of a bag can be wrapped over and maintained in a taut condition over a flange that defines the at least one pair of said slots by feeding excess material from the upper portion through at least one slot and securing the excess material to the at least one tensioning element.

The bag retention system may further comprise, a. at least one divider element for use in dividing the interior of the peripheral side wall element into multiple interior spaces, b. fastening means for releasably fastening the at least one divider element to the peripheral side wall element.

The bag retention system may further comprise a coupling system adapted to also couple the at least one divider to another divider, e.g. at least one divider connector comprising a bottom and a channel defined in the bottom dimensioned and shaped to receive top edges of multiple dividers to hold the multiple dividers together. The divider connectors may comprise a top which is shaped and dimensioned to define at least one flange that cooperates with and extends away from at least one flange of the peripheral side wall, whereby a bag can be inserted in a divided interior space of the peripheral side wall between cooperating flanges and an upper portion of the bag and be wrapped around the cooperating flanges and maintained in a taut condition using at least one tensioning element.

The bag retention system may be designed such that surfaces on which an upper portion of a bag is to be maintained in a taut condition are rounded to avoid tearing of the bag, as may occur when plastic bags are employed.

An accordance with a second aspect, the invention provides a receptacle for the temporary on-site storage of discarded matter comprising the bag retention system according to the first aspect. The receptacle may have a bottom wall (this is optional when bags are used) and a peripheral upstanding side wall coupled to and extending upwardly from the bottom wall. The peripheral upstanding side wall may be any shape in cross-section, e.g. circular, rectangular, hexagonal, etc.

The peripheral side wall of the bag retention system may be rigidly coupled to the peripheral upstanding side wall of the receptacle or integrally formed therewith.

The receptacle may comprise at least one divider (e.g. a planar member) for dividing the interior of the receptacle into a plurality of compartments, and which can be spaced a substantial distance from the bottom of the receptacle or extend part-way or all the way down thereto. To more firmly hold the at least one divider in position in the receptacle, the at least one divider may have at least one side edge and a bottom edge, and the upstanding side wall of the receptacle may have an inner surface defining at least one vertically extending groove that is shaped and dimensioned to slidably receive respective side edges of the at least one divider, and/or a bottom wall that has an inner surface which defines at least one groove that is shaped and dimensioned to slidably receive the bottom edge of the at least one divider. The receptacle may also have at least one rib defined by the inner surface of at least one of the upstanding peripheral side wall of the receptacle and the peripheral side wall element of the bag retention system that engages the at least one side edge of the at least one divider. In some embodiments, the at least one groove and the at least one rib are aligned vertically.

The receptacle may further comprise a lid sized and shaped to cover an opening to the receptacle, the lid comprising at least one removable opening plate, each opening plate defining a plate opening through which discarded matter can be thrown into the receptacle. When two or more opening plates are used, each opening plate may correspond to a compartment within the receptacle, and the opening plates may be sized, shaped and configured to fit together with each other. The receptacle may also comprise diverters for channeling discarded matter from the plate openings to the corresponding compartments within the receptacle.

In some embodiments, the receptacle can be used without a lid and opening plates but have an exterior housing comprising a top wall and a peripheral side wall coupled to and extending downwardly from the top wall. At least one of the top and peripherals side walls of the exterior housing may comprises at least one removable opening plate, each opening plate defining a plate opening through which discarded matter can be thrown into the receptacle. When a plurality of opening plates are used, each opening plate may correspond to a compartment within the receptacle, and the opening plates may be sized, shaped and configured to fit together with each other.

The exterior housing may comprise a sign holder and signage releasably retained in the sign holder that has graphics showing a user what material is to be thrown into each plate opening. The housing may also have diverters for channeling discarded matter from the plate openings to the corresponding compartments within the receptacle.

The present invention allows a user to select the size and number of compartments in order to maximize the time interval between emptying of the receptacle and thereby reduce costs. If the relative proportions of the different types of discarded matter change over time or if the absolute quantities of such materials change, the receptacle can be easily reconfigured in the field without the need for special tools or expertise. The modularity and interchangeability of components in the receptacle system means that a large number of different configurations can be achieved with a minimal number of parts.

BRIEF DESCRIPTION OF THE DRAWINGS

The invention will be better understood with reference to the drawings in which:

FIG. 27 is an exploded isometric view of the assembly of FIG. 23;

FIG. 28 is an enlarged view of the bracket designated by reference letter N in FIG. 27;

FIG. 29 is an enlarged view of a tensioning element according to one embodiment designated by reference letter O in FIG. 27;

DETAILED DESCRIPTION

When used herein, relative terms such as "upwardly," "downwardly," "horizontal," "vertical," "top," "bottom," "inner," "outer," and the like are used for the sake of convenience only and refer to articles in their normal "in-use" and assembled state. These terms, when employed in the claims, are not intended to limit the subject matter to the "in-use" orientation or assembled configuration.

The term "comprising" means including without limitation. The term "consisting of" means including only the recited elements and such additional elements that may form a part of the recited elements. The term "consisting essentially of" means including only the recited elements and such additional elements as would not materially affect the basic and novel properties of the invention.

Figure 1:
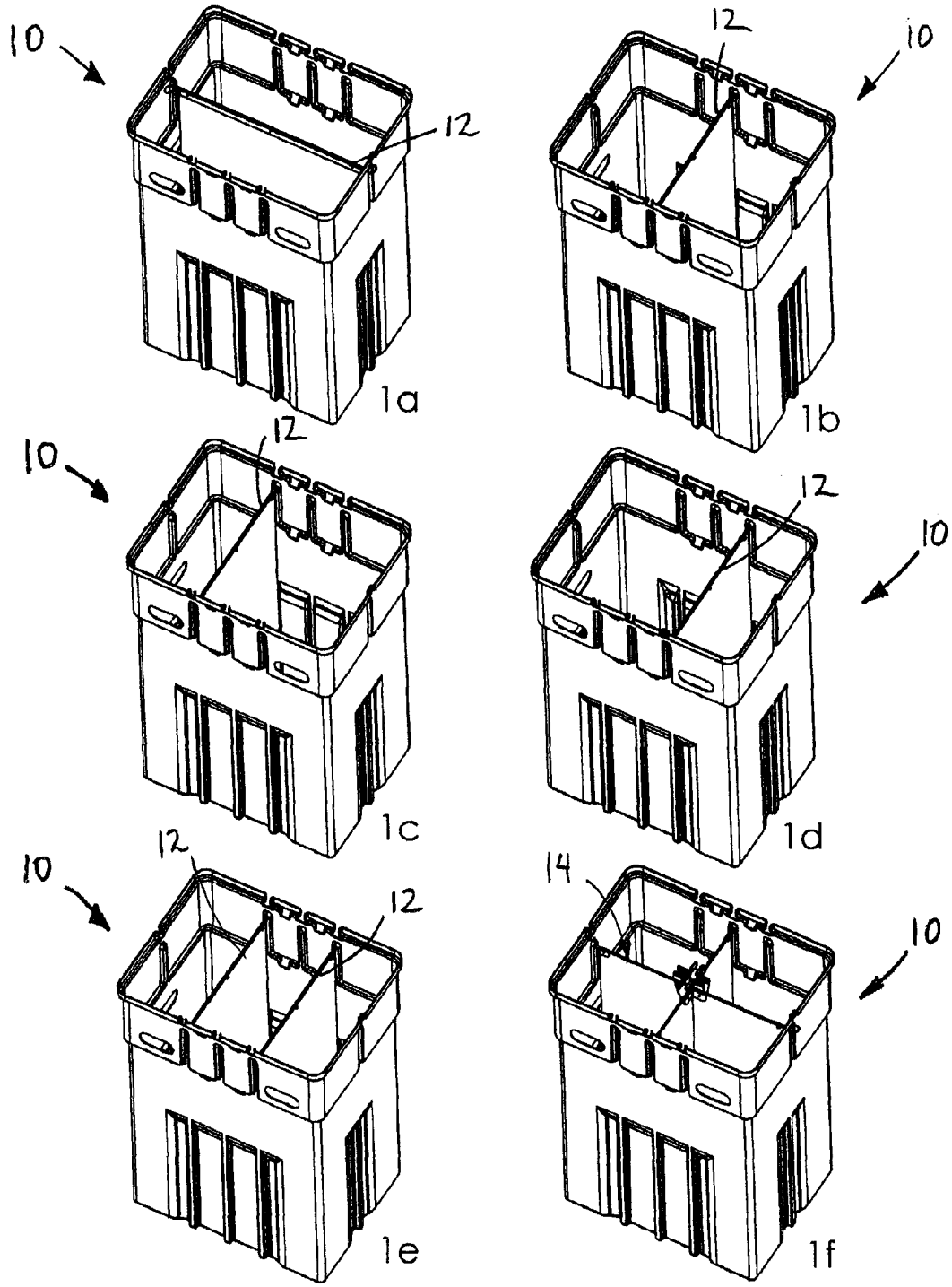
FIGS. 1*a-f* are isometric views of a receptacle, according to one embodiment, shown with one or more dividers positioned and releasably fastened therein, and including parts of a bag retention system also according to one embodiment.
Figure 31:
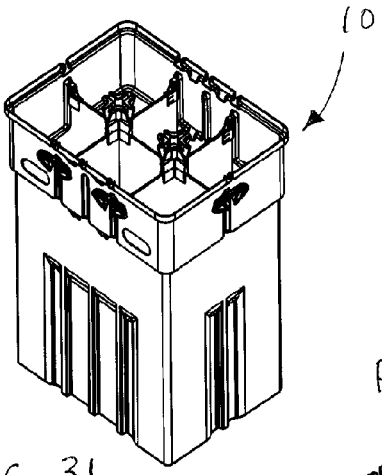
FIG. 31 is an isometric view of a receptacle assembly comprising the receptacle of FIGS. 1*a-f* shown divided into six compartments using a divider assembly according to one embodiment.
Figure 32:
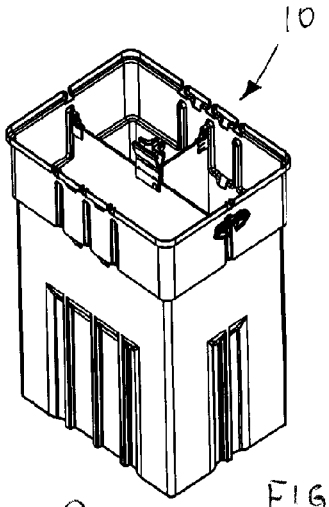
FIG. 32 is is an isometric view of a receptacle assembly comprising the receptacle of FIGS. 1*a-f* shown divided into three compartments using a divider assembly according to another embodiment.
Figure 33:
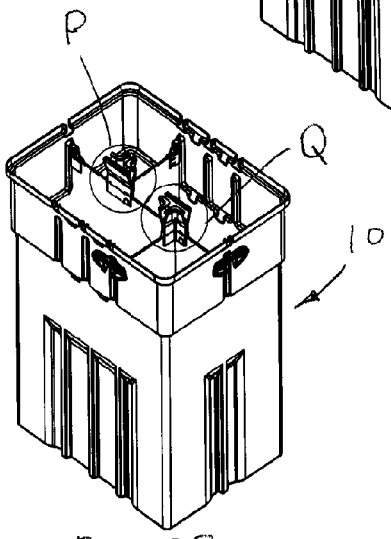
FIG. 33 is an isometric view of a receptacle assembly comprising the receptacle of FIGS. 1*a-f* shown divided into four off-set compartments using a divider assembly according to yet another embodiment.

Referring to FIGS. 1*a-f* and 31, 32, and 33, a receptacle in the form of a liner designated generally by reference numeral 10 is shown. The liner 10 can be used by commercial or industrial establishments for the temporary on-site storage of discarded matter, such as garbage or recycling. In this specific embodiment, the liner 10 is made by rotational molding using linear low-density poly-ethylene but can be made of other suitable materials and manufacturing methods. The liner 10 is adapted to receive one or more removable, rectangular, planar dividers 12 in one of a plurality of positions in order to provide a plurality of compartments within the liner. FIGS. 1*a-e*, and 31, 32, and 33 illustrate selected divider positions by way of example only. The liner can also accept a removable divider assembly 14 as shown in FIG. 1*f* that functions to divide the liner into four compartments. Alternative divider assembly configurations are shown in FIGS. 31, 32, and 33.

Referring to FIGS. 2, 3, 4, 5, 6 and 7, the liner 10 can be used in combination with a lid designated generally by reference numeral 17 (FIGS. 2 and 3) or in combination with an exterior housing designated generally by reference numerals 19*a*, 19*b*, 19*c*, and 19*c* (FIGS. 4, 5, 6, and 7), sized and shaped to receive the liner 10 and other components therein, as will be further described below.

Figure 15:
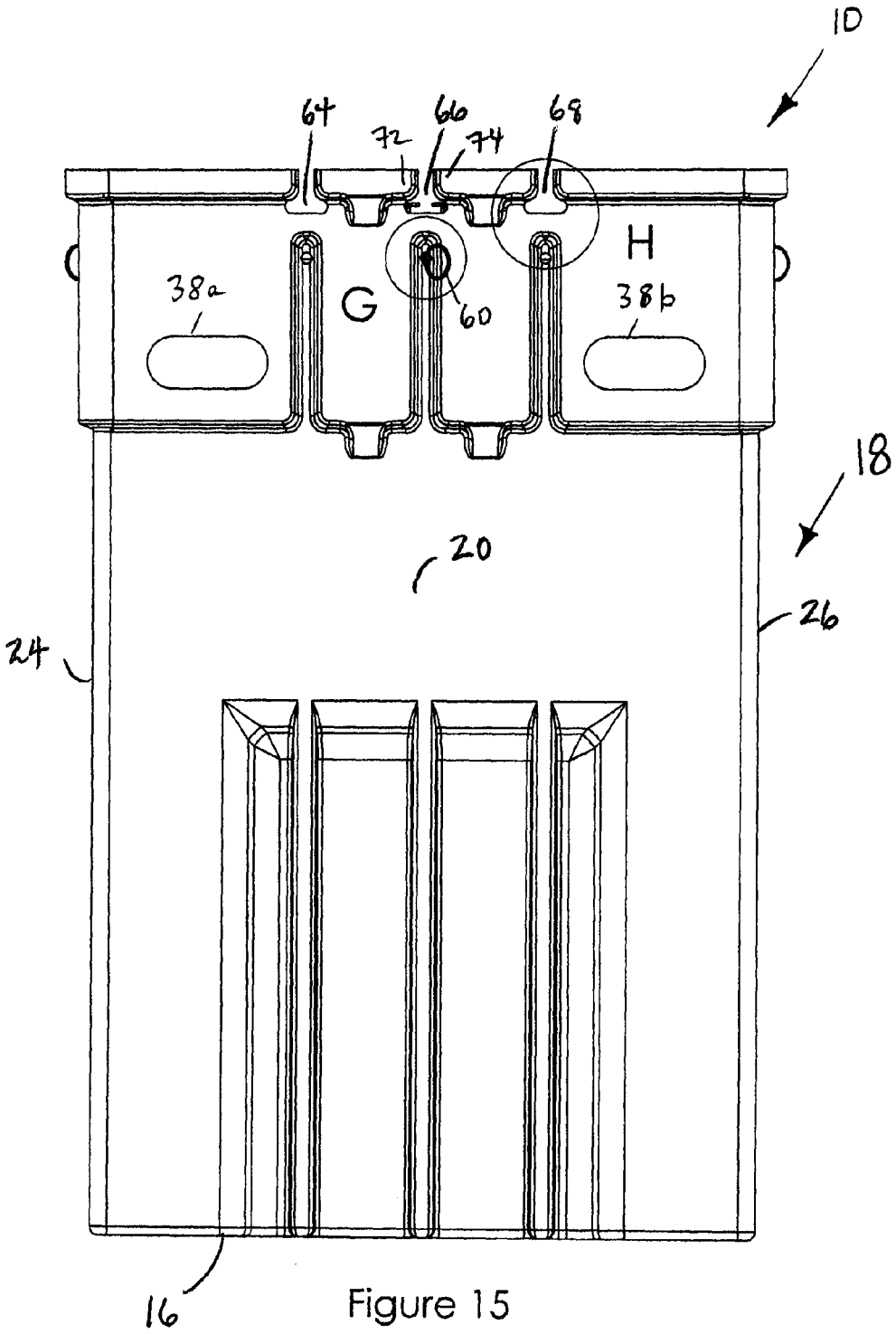
FIG. 15, is side or elevational view of the receptacle of FIG. 8 showing one side wall element of a first pair of opposed side wall elements.
Figure 16:
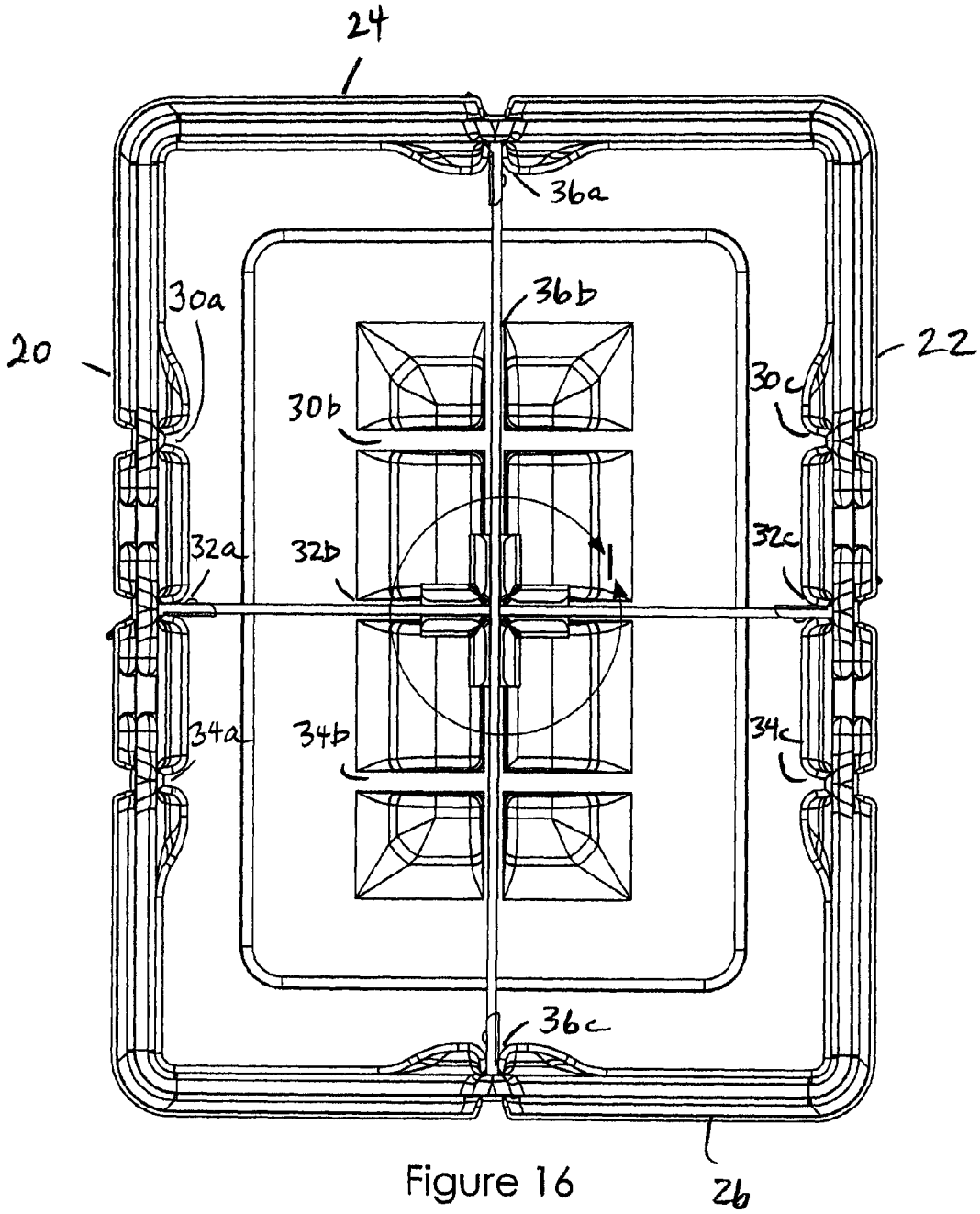
FIG. 16 is a top view of the subassembly of FIG. 11.

Referring to FIGS. 15 and 16, the liner 10 comprises a bottom wall 16 and a peripheral upstanding side wall designated generally by reference numeral 18 that is integrally formed with and extends upwardly from the bottom wall 16. The side wall 18 has a first pair of spaced apart and opposing side wall elements 20, 22, and a second pair of spaced apart opposing side wall elements 24, 26 extending between and connecting the first pair of side wall elements 20, 22.

Referring to FIG. 15, two openings 38*a* and 38*b* are formed in the side wall element 20 and function as handles to allow a user to pick up or move the liner 10 such as when the liner 10 is being emptied.

In order to create compartments in the liner 10, a divider assembly 14, which serves to divide the interior of the liner 10 into four compartments, is positioned in the liner using positioning means in the form of grooves that will now be described.

Referring to FIG. 16, the liner 10 has four sets of grooves defined by the inner surface of the liner 10, namely, three sets of grooves 30*a*, 30*b*, 30*c*, 32*a*, 32*b*, 32*c*, 34*a*, 34*b*, 34*c* formed in a bottom portion of the first pair of opposing side wall elements 20, 22 and the bottom wall 16, and a fourth set of grooves 36*a*, 36*b*, and 36*c* formed in a bottom portion of the second pair of opposing side wall elements 24, 26. Each set of grooves, consists of one pair of opposed upwardly extending grooves (e.g. 32*a*, 32*c*) formed one on each opposing side wall elements (e.g. side wall elements 20, 22) and a groove in the bottom wall 16 (e.g. 32*b*). In this embodiment, the grooves are designed to have lengths that serve to also provide added reinforcement and support for dividers positioned therein. The lengths of the grooves are selected impede bowing and dislodgement of the dividers within the liner.

Figure 9:
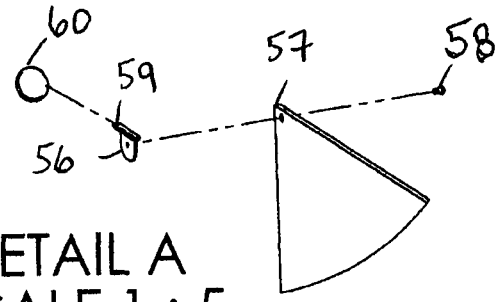
FIG. 9 is an enlarged view of the portion designated by letter A in FIG. 8.
Figure 10:
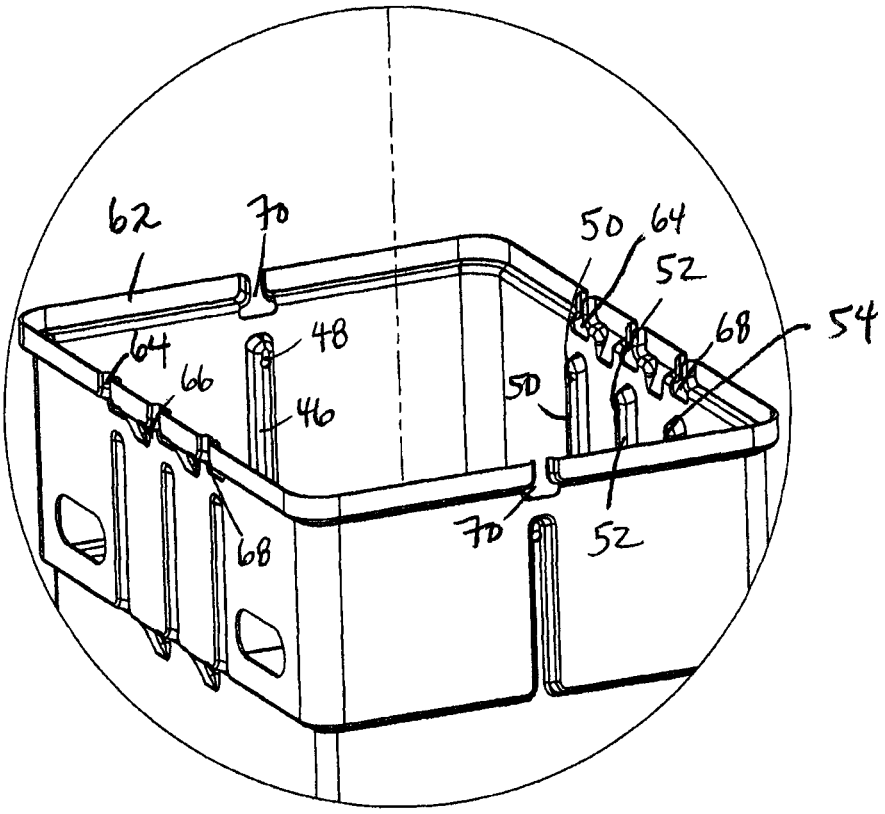
FIG. 10 is an enlarged view of the portion designated by letter B in FIG. 8.
Figure 11:
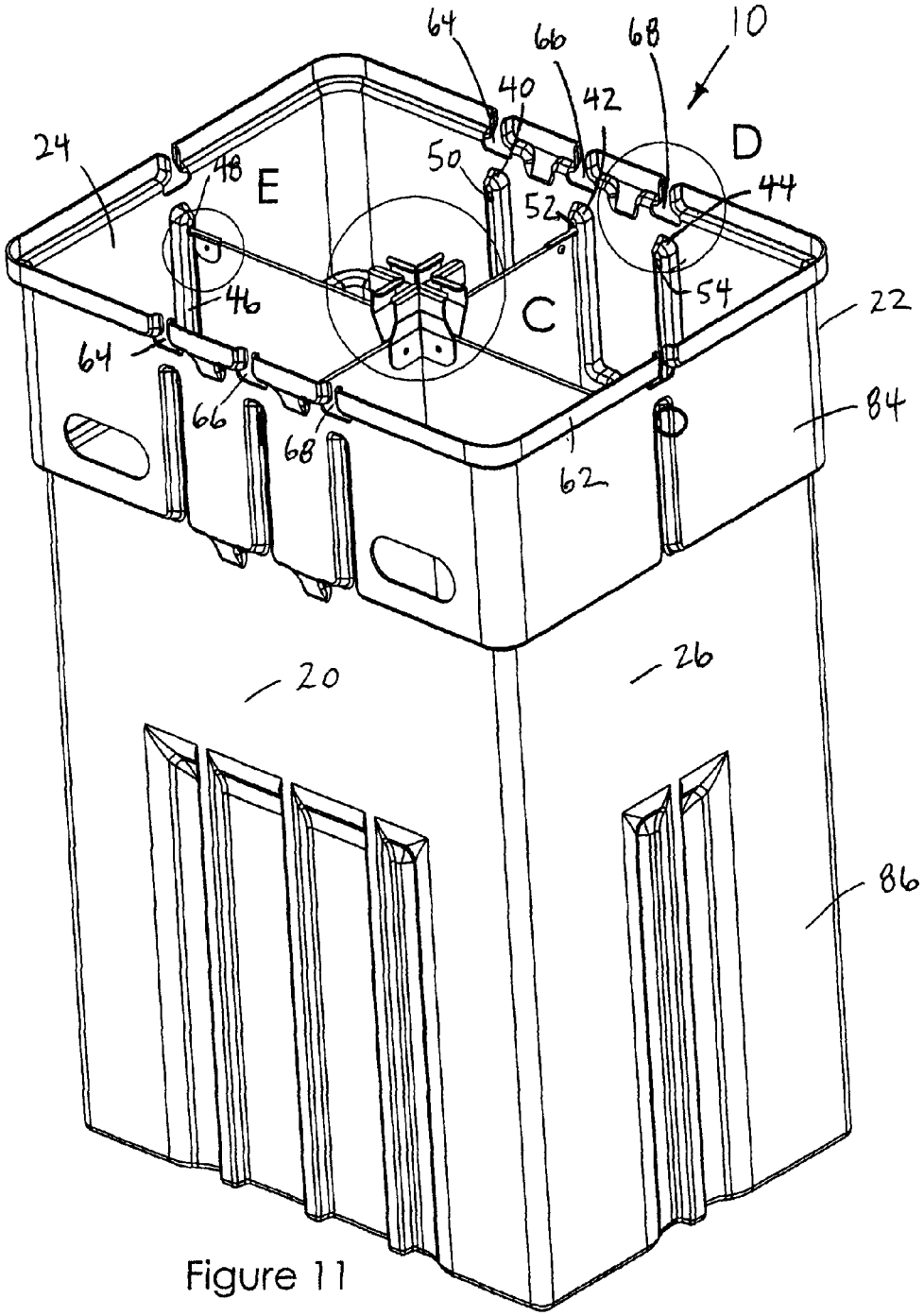
FIG. 11 is an isometric view of parts of the receptacle system of FIG. 8 including a rim retention system, receptacle, and dividers.
Figure 12:
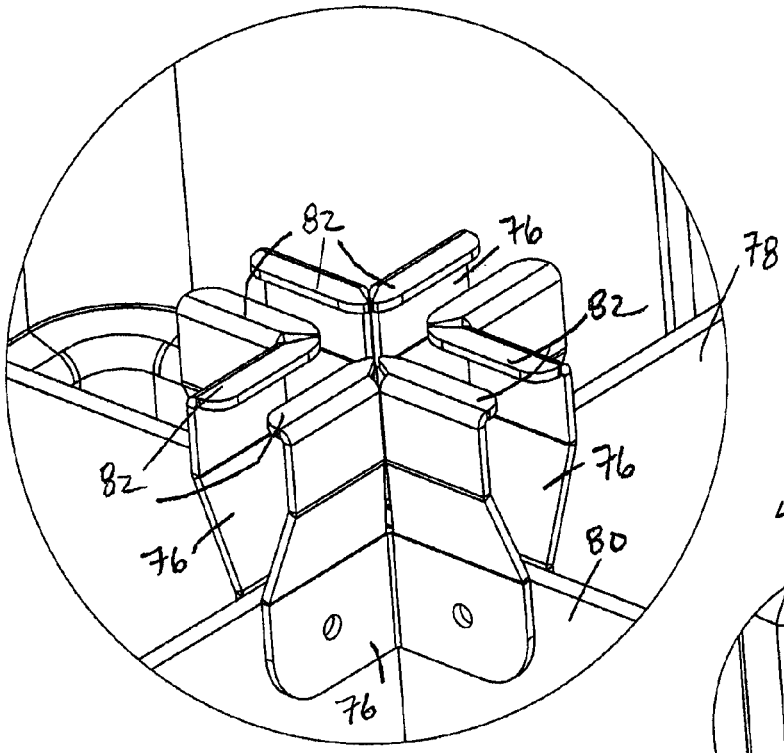
FIG. 12 is an enlarged view of the portion designated by letter C in FIG. 11.

The divider assembly 14 is releasably fastened to the liner 10 using releasable fastening means shown in FIGS. 8, 9, 10, 11, 14, 15, 16 and 17. Referring to FIG. 11, the liner 10 has holes, 48, 50, 52, and 54 formed in respective upwardly extending ribs formed on the inside of an upper portion of the liner 10 (only ribs 40, 42 and 44 of side wall element 22, and only rib 46 of side wall element 24, being shown in FIG. 11). In this embodiment, side wall elements 20, 22, each have three ribs, while side wall elements 24, 26, each have one rib. The ribs enhance the structural integrity of the liner and are in line with corresponding grooves in the side wall elements to provide surfaces that mate with edges of the divider assembly 14 (best seen in FIGS. 1, 15 and 16). Thus, it can be seen that the ribs and corresponding sets of grooves lie in the same plane in order to meet planar edges of the divider assembly 14.

Holes in an upper portion of each rib are used to releasably fasten the divider assembly 14 to the liner 10 in FIG. 1*f*. Only hole 48 in rib 46 and holes 50, 52, 54 in ribs 40, 42, 44 are shown in FIGS. 10 and 11.

Figure 8:
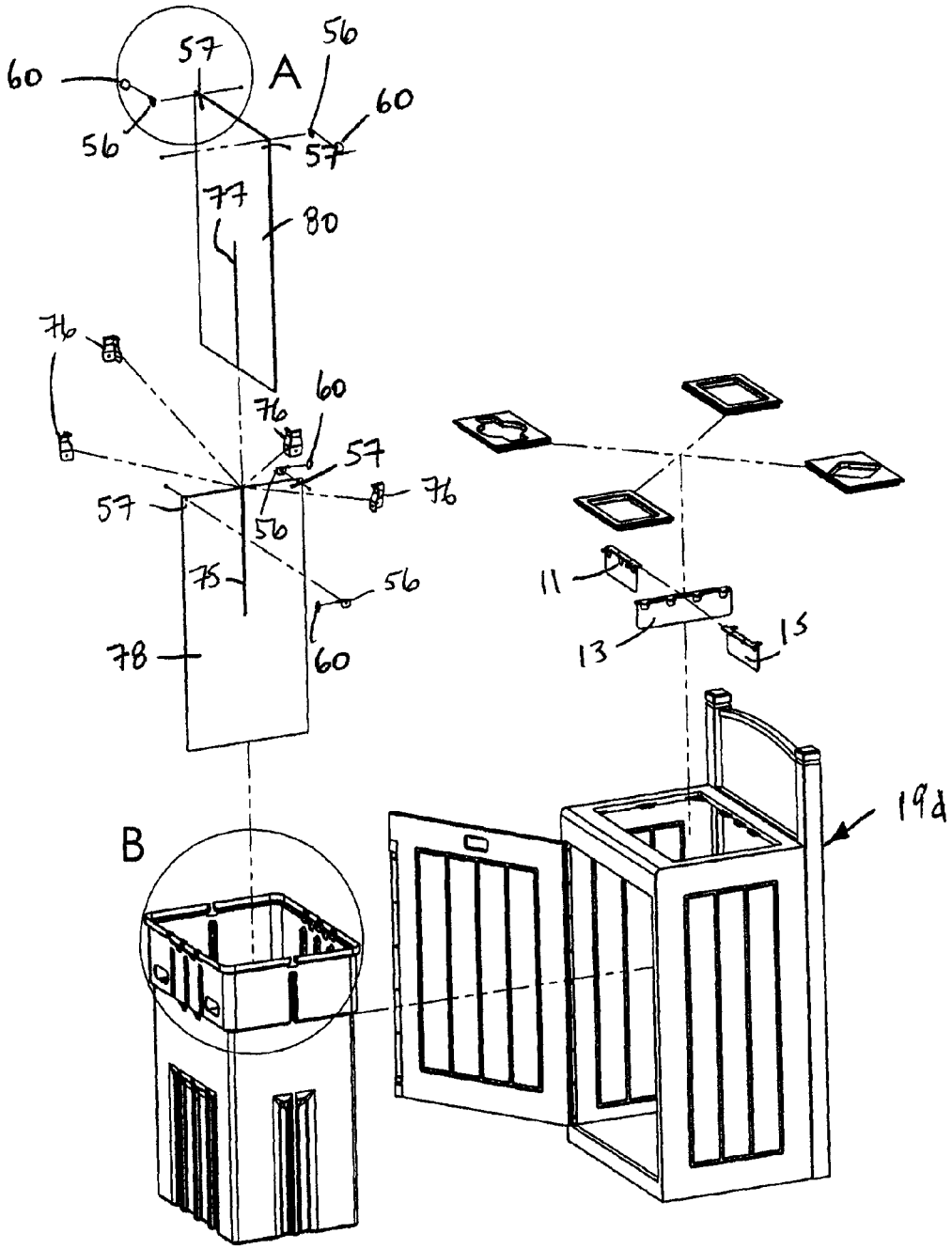
FIG. 8 is an exploded isometric view of the receptacle system of FIG. 7, showing most of the components thereof, including the receptacle of FIGS. 1*a-f* that is hidden from view in FIG. 7.
Figure 14:
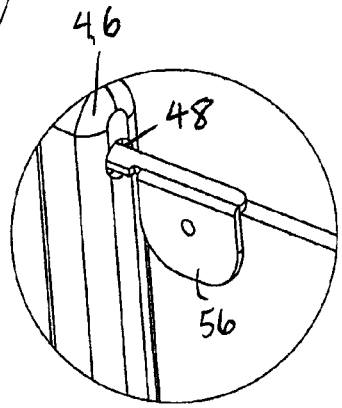
FIG. 14 is an enlarged view of the portion designated by letter E in FIG. 11.
Figure 17:
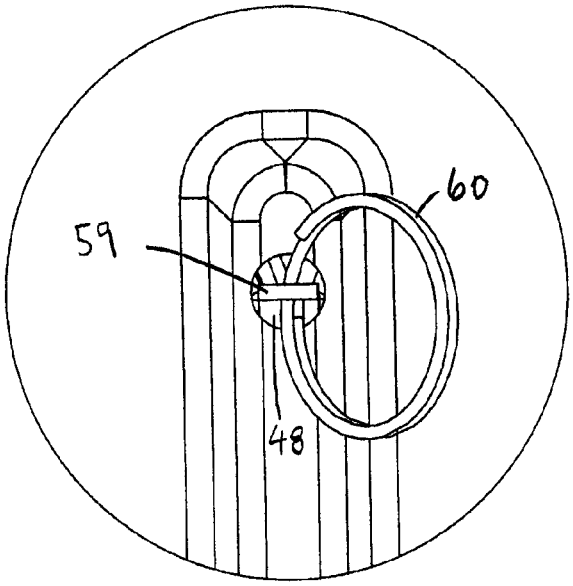
FIG. 17 is an enlarged view of the portion designated by letter G in FIG. 15.
Figure 19:
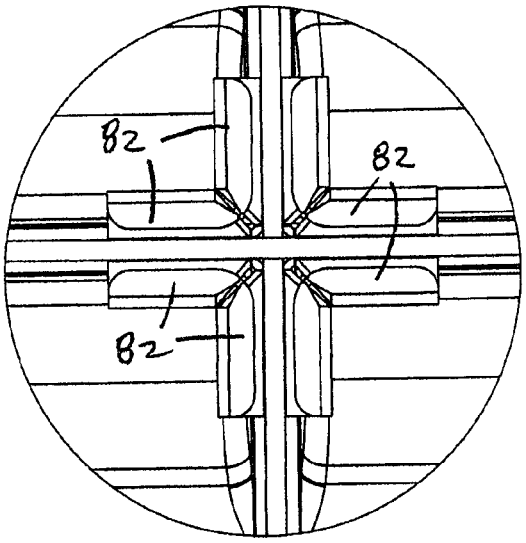
FIG. 19 is an enlarged view of the portion designated by letter I in FIG. 16.

Referring now to FIGS. 9, 14 and 17 (which are enlarged views of the portions designated by letters A, E, and G in FIGS. 8, 11 and 15, respectively), a bracket 56 is secured to a top corner 57 of the divider assembly 14 using a screw 58 (see FIG. 9) and includes an integral pin 59 (FIGS. 9 and 17) that extends through the opening 48 of the rib 46. On the outside of the side wall element 24 is releasably fastened a coiled ring 60 (FIGS. 9 and 17) that is inserted through an aperture in the pin 59 and acts as a stop to prevent the top corner 57 of the divider assembly 14 from disengaging from side wall element 24. Similar structures are provided in association with the other three top corners 57 of the divider assembly 14 (see FIG. 8) to hold the divider assembly in place in the liner 10. To remove the divider assembly, the coiled rings 60 are removed from the pins 59, and the divider assembly 14 is simply pulled out of the liner 10 by bending the flexible walls of the side wall elements 20, 22, 24, 26 outwardly to disengage the pins 59 of the brackets 56 from the openings in the ribs.

Figure 13:
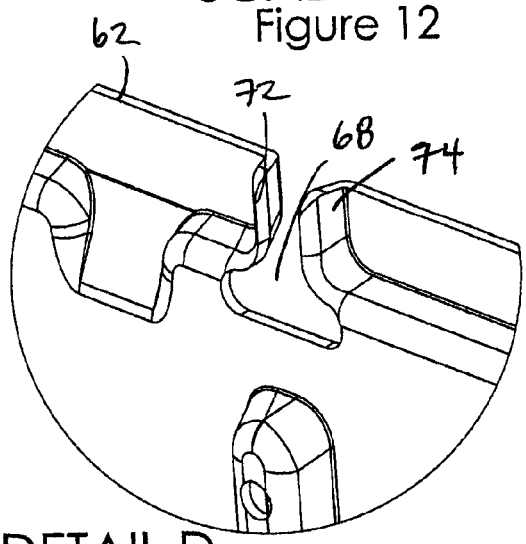
FIG. 13 is an enlarged view of the portion designated by letter D in FIG. 11.
Figure 18:
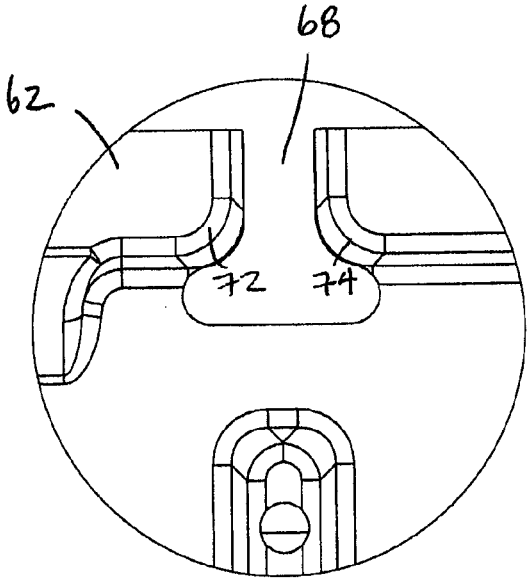
FIG. 18 is an enlarged view of the portion designated by letter H in FIG. 15.

The liner 10 is designed to include bag retention means for retaining a top end portion of a recycling or waste bag (as shown in 21*b* and 22) on the liner 10. Referring to FIGS. 10 and 11, and also to FIGS. 12, 13, 18 and 19 which are enlarged views of the portions designated by letters C, D, H, and I in FIGS. 11, 15 and 16, respectively, the liner 10 includes a rim 62 that extends along the top edge of the side wall elements 20, 22, 24, 26. The rim 62 is interrupted by (in this embodiment) four pairs 64, 66, 68, 70 of opposed rounded slots positioned in line with corresponding ribs and grooves in the side wall elements 20, 22, 24, 26, the pairs of slots 64, 66, 68 and 70 being used, in combination with the rim 62, to retain a top end portion of a waste or recycling bag in compartments of the liner 10 when a divider is positioned and releasably fastened to the liner 10. As can be best seen with reference to FIGS. 13 and 18, each slot tapers from bottom to top to define a pair of opposed overhangs 72, 74 integrally formed with the rim 62 to better retain a top end portion of a waste or recycling bag in compartments of the liner when a divider is positioned and releasably fastened to the liner 10. When no divider is present in the liner 10, i.e. the liner 10 is used to form a single compartment, only the rim 62 is used to retain a waste/recycling bag inside the liner 10. As will be readily understood the top end portion of a waste/recycling bag can be hooked around the rim 62 or the rim in combination with the overhang that is immediately adjacent to a divider or divider element. The rim 62, overhangs 72,74 and rim elements 82 are devoid of sharp edges that may tear a plastic bag wrapped thereover or therearound.

Referring now to FIG. 8, the divider assembly 14 is made using two divider plates 78, 80 that fit together using respective slits 75, 77 that extend half-way through each divider plate 78, 80 and mid-way between two parallel side edges thereof. Once mated together, the divider plates 78, 80 are secured perpendicularly to each other using four right-angled brackets 76 that are screwed together (see FIGS. 8 and 12). As can be best seen with reference to FIG. 12, the right-angled brackets 76 have top end portions that are bent at 90 degrees inwardly to create rim elements 82 that form a part of the bag retention means in this embodiment. Bags that are used in this example are hooked around the rim of the liner 10, overhangs 72, 74 corresponding to the pairs of middle slots 66 and 70 and the rim elements 82 formed by the angled brackets 76.

Figure 20:
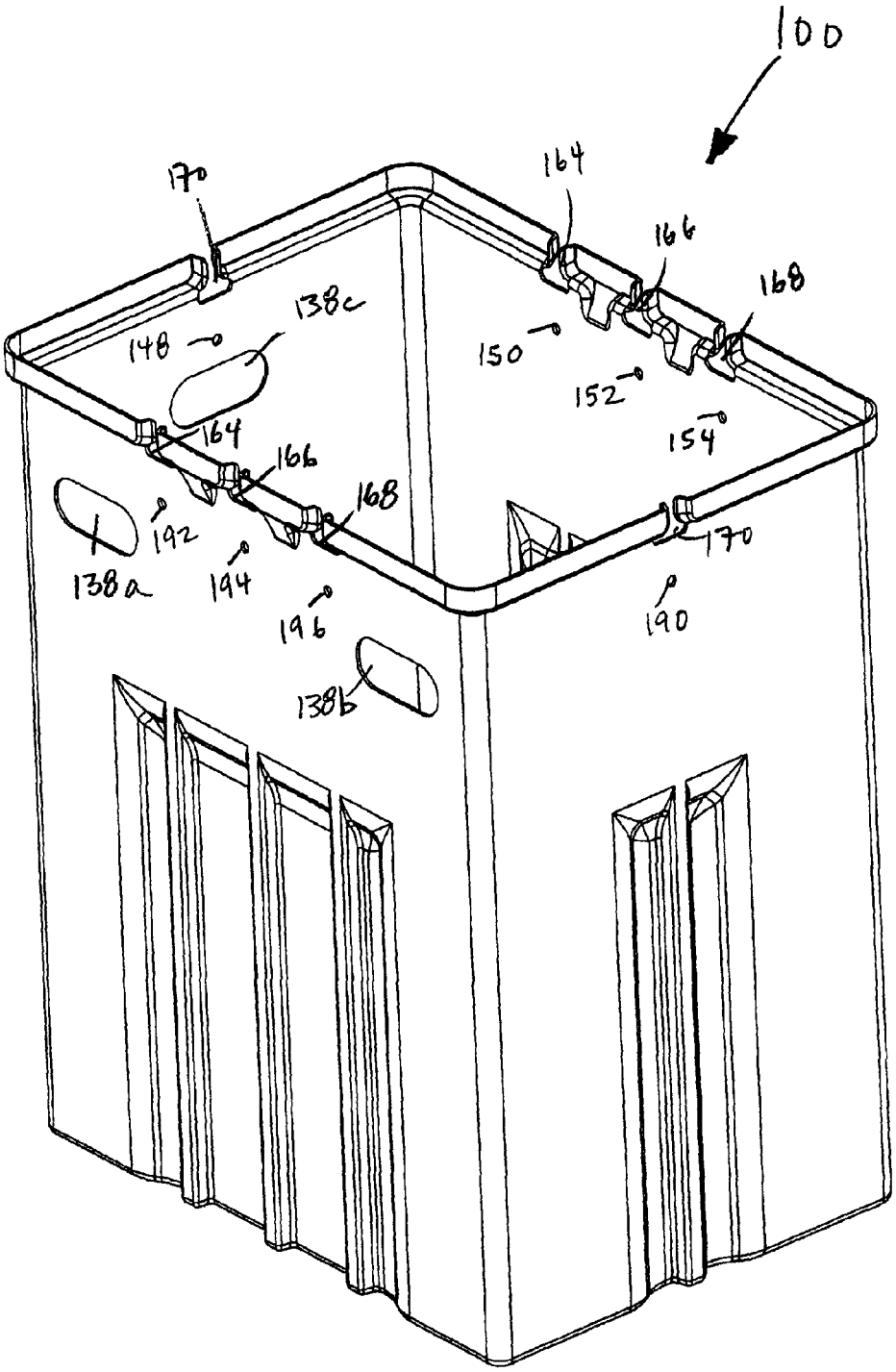
FIG. 20 is an isometric view of a shorter receptacle according to another embodiment of the invention.

Referring now to FIG. 11, for example, the liner 10 has an upper end portion 84 and a lower end portion 86 integrally formed with the upper end portion 84 at one end and with the bottom wall 16 on an opposite end. The upper end portion 84 has a larger cross-section than the lower end portion 86 so that a rim is automatically formed if a top portion of the liner 10 is cut off anywhere in the upper end portion (see, e.g. FIG. 20). Furthermore, the upper end portion 84 has a uniform cross-section such that, after a top portion is cut-off in the area of the upper end portion 84, similar cross-sectional features are retained. FIG. 20 illustrates an example of a second embodiment of a liner 100 that is formed by cutting a top portion off of the liner 10 at a location near the bottom of the upper end portion 84. After cutting and removing the top portion, the cut edge is routered to create the pairs of tapered slots 164, 166, 168, 170 and opposed overhangs associated with each slot. The cut edges are also filed to remove any sharp edges that may tear a plastic bag retained thereon. Additional openings 138*a*, 138*b*, 138*c* are cut to form handles for the new shorter liner 100. Similarly, holes 148, 150, 152, 154, 190, 192, 194 and 196 are also cut to allow use of the fastening means described above. It will be appreciated that liners of varying heights can be made by cutting the liner 10 at different locations within the upper end portion 84 and then processed as described above. Depending on the location of the cut, the resulting article may or may not have ribs, which are not essential to the invention.

Referring now again to FIGS. 2 and 3, the liner 10 can be used in a receptacle system that further comprises a lid designated generally by reference numeral 88 to cover the top opening of the liner 10. The lid 88 comprises 3 opening plates 89, 91, 93, each opening plate 89, 91, 93 defining a plate opening 95, 97, 99 through which discarded matter can be thrown into the liner 10. Although not shown in FIG. 3, the opening plates 89, 91, and 93 are intended to correspond to respective compartments within the liner, such as the compartments shown in FIG. 1*e* formed by positioning and releasably fastening two planar dividers 12 as shown within the liner 10.

The opening plates 89, 91 and 93 are sized, shaped and configured to fit together with each other like pieces of a puzzle and also within and as part of the lid 88. The plate openings 95, 97 and 99 are also of a different size and shape to facilitate user compliance with regards to what materials should be thrown into which compartments.

As can be seen with reference to FIG. 8, the plate openings can be the same size and shape and need not be different. Also, the system may further include diverters 11, 13, and 15 for channeling discarded matter from the plate openings to the corresponding compartments within the liner 10.

Figure 2:
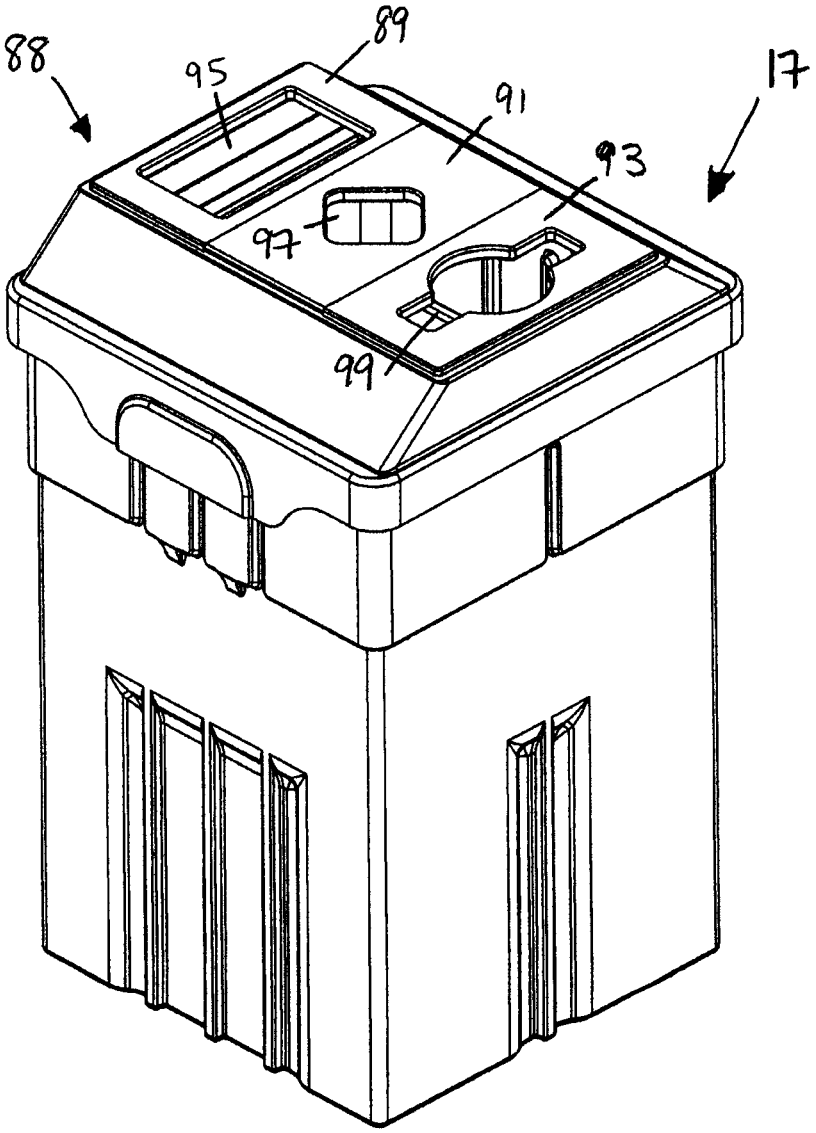
FIG. 2 is an isometric view of a receptacle system according to one embodiment in an assembled state comprising the receptacle of FIGS. 1*a-f*, and a lid that includes removable, modular, and interchangeable opening plates.
Figure 3:
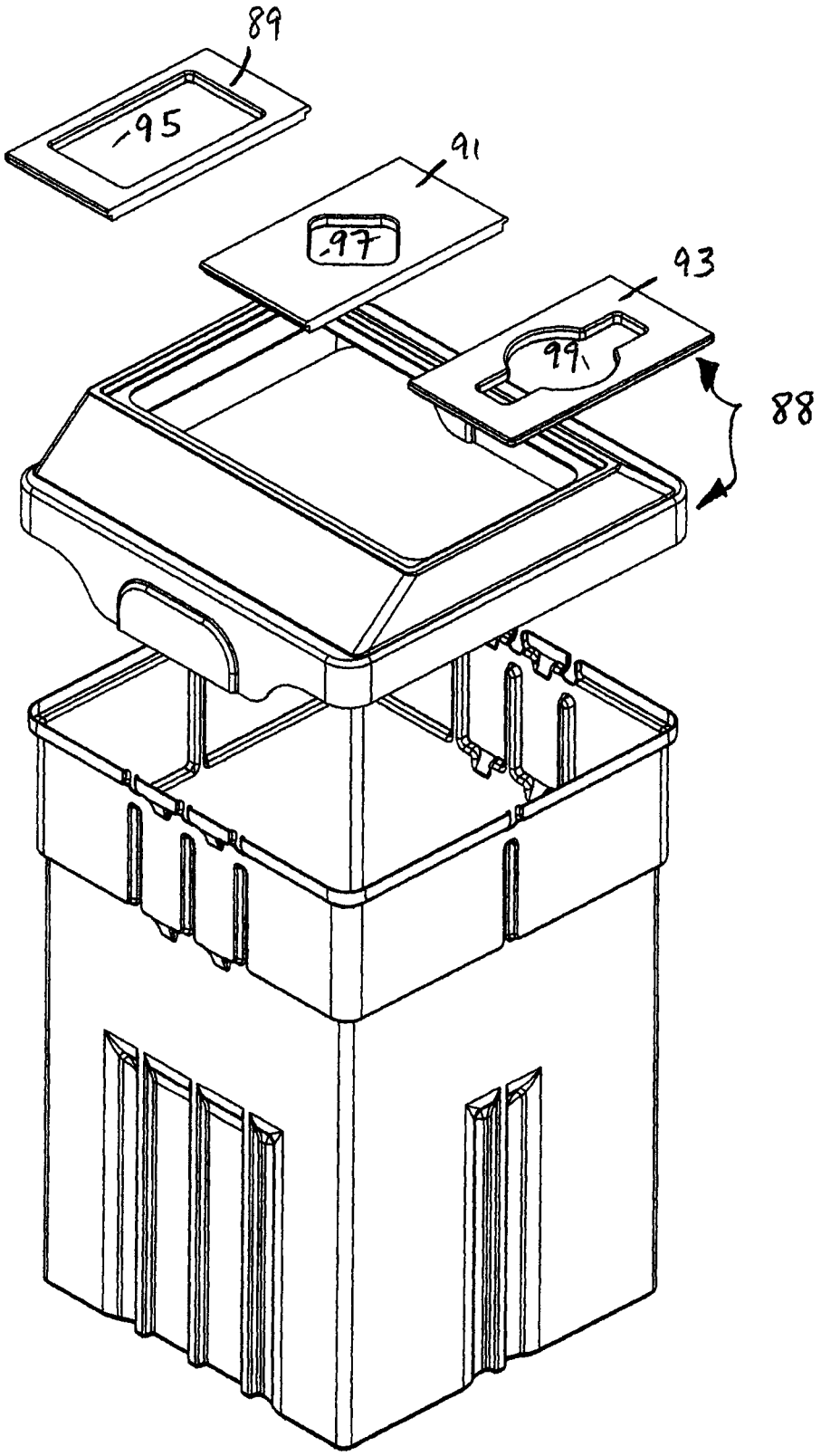
FIG. 3 is an exploded isometric view of the receptacle system of FIG. 2.

Although not shown in FIGS. 2 and 3, it will be appreciated that the lid may be configured to have the opening plates in a front wall thereof rather than in a top wall (as shown), as will be understood with reference to the below description of alternative embodiments of the present receptacle system.

Referring now again to FIGS. 4 to 8, the receptacle system may further comprise an exterior housing such as housings designated generally by reference numerals 19*a*, 19*b*, 19*c*, and 19*d* shown in these figures. The housing may further comprise a sign holder adapted to releasably hold and display signage. The housings 19*a*, 19*b*, and 19*d* (FIGS. 4, 5, and 7) each are configured to include sign holders 21*a*, 21*b* and 21*d* for releasably retaining signage displaying graphics, for example, graphics showing a user what material is to be thrown into each plate opening.

As illustrated in FIGS. 2 to 7, the opening plates are removable and modular and can vary in size and shape so as to be useful for systems having compartments that are variable in size or number. The modularity of the opening plates allow them to be used both as part of lids (such as the lid 88 described above) or as part of an exterior housing, such as those shown in FIGS. 4-7.

Figure 4:
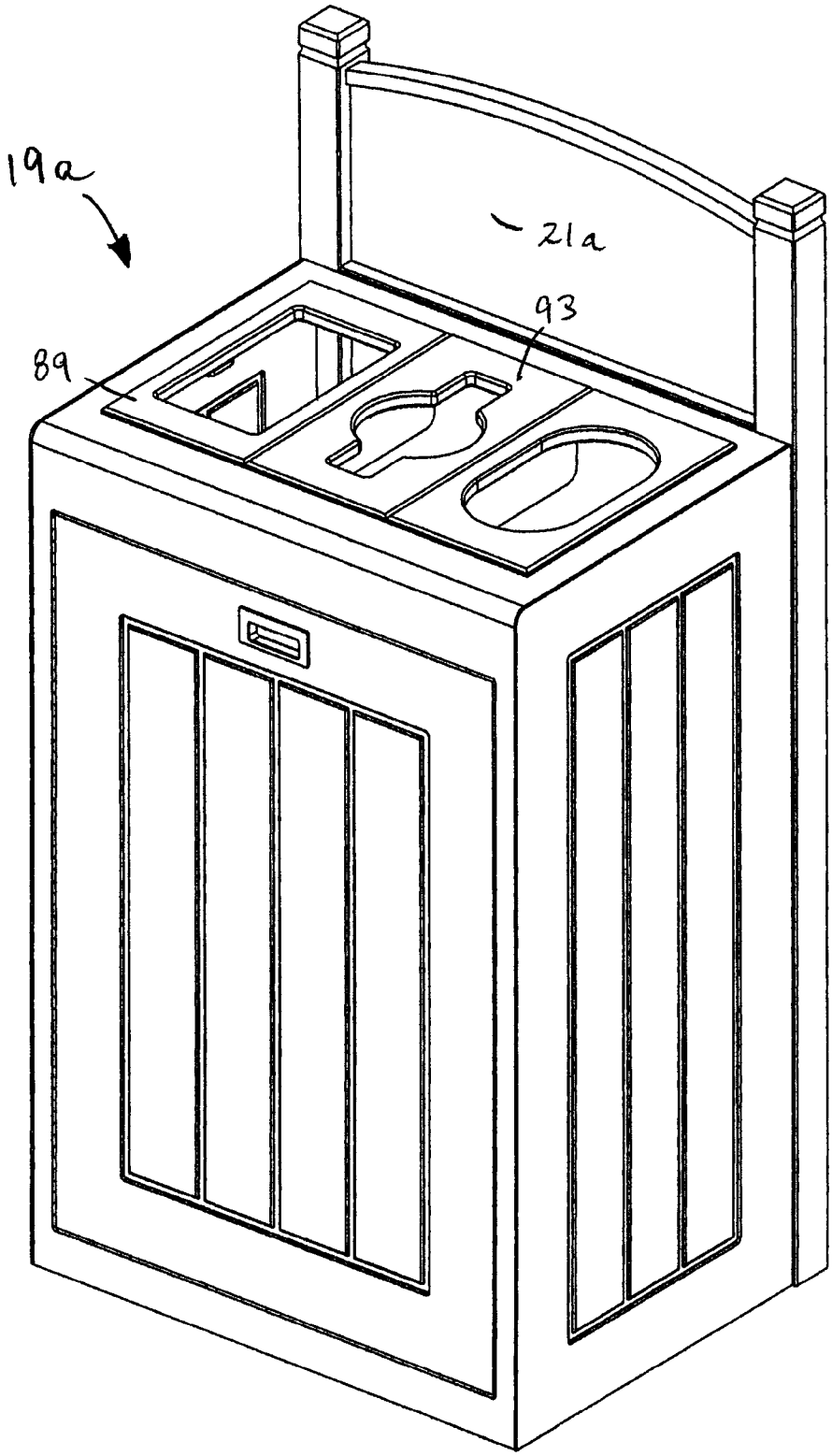
FIG. 4 is an isometric view of a receptacle system according to another embodiment of the invention, the system comprising an exterior housing which includes (i) an upstanding sign holder for releasably retaining interchangeable signs (not shown) and (ii) removable, interchangeable, modular opening plates positioned in a top wall of the housing.
Figure 7:
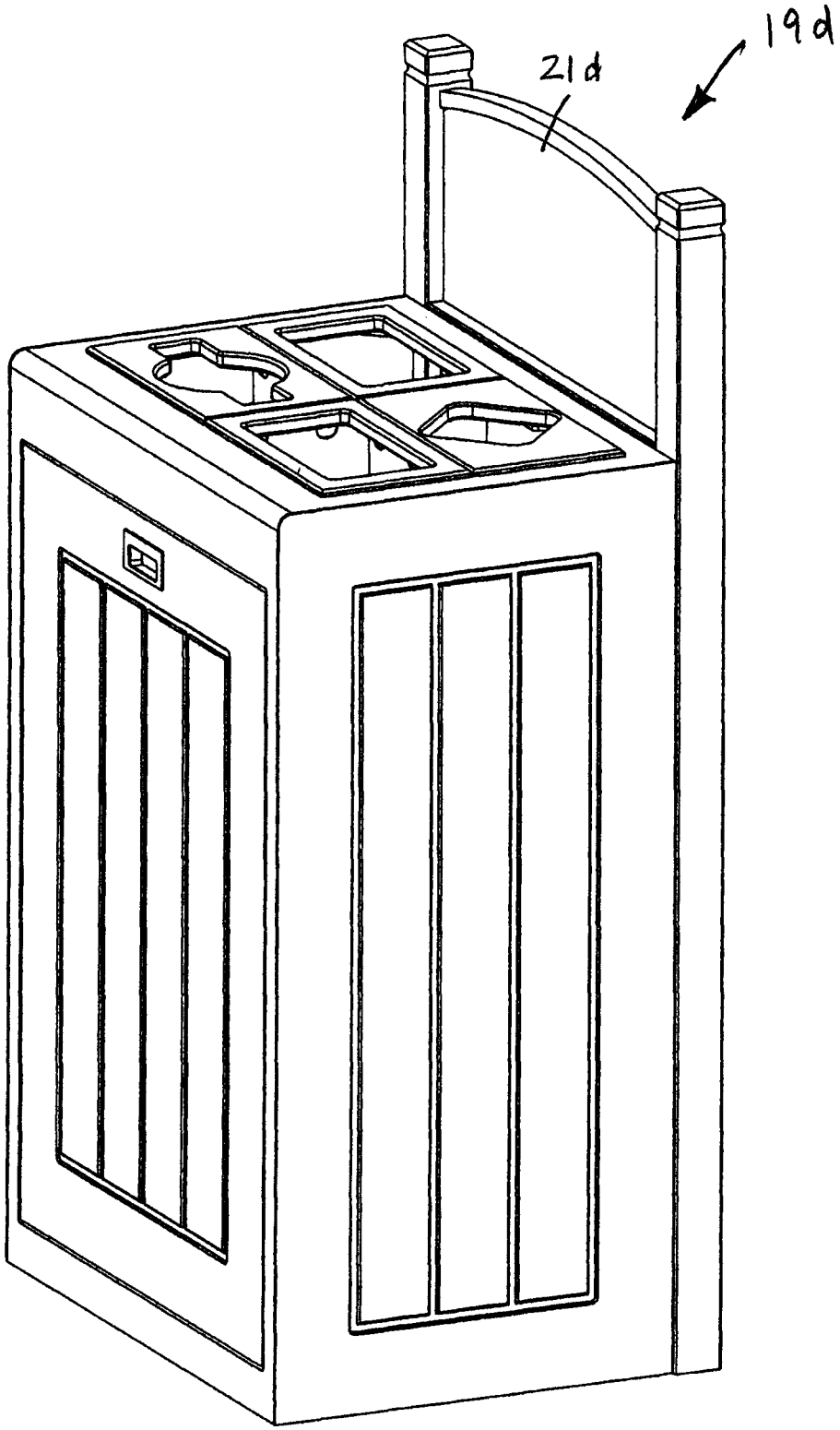
FIG. 7 is an isometric view of a receptacle system according to yet another embodiment of the invention comprising an exterior housing which includes an upstanding sign holder for releasably holding signage (not shown) and four removable, interchangeable, modular opening plates incorporated in a top wall of the housing.

The sign holder can be incorporated into the liner or housing in one of a variety of locations. Examples of different locations are shown in FIGS. 4, 5 and 7; however, numerous variations to these examples would be readily apparent to the person of ordinary skill in the art.

Figure 5:
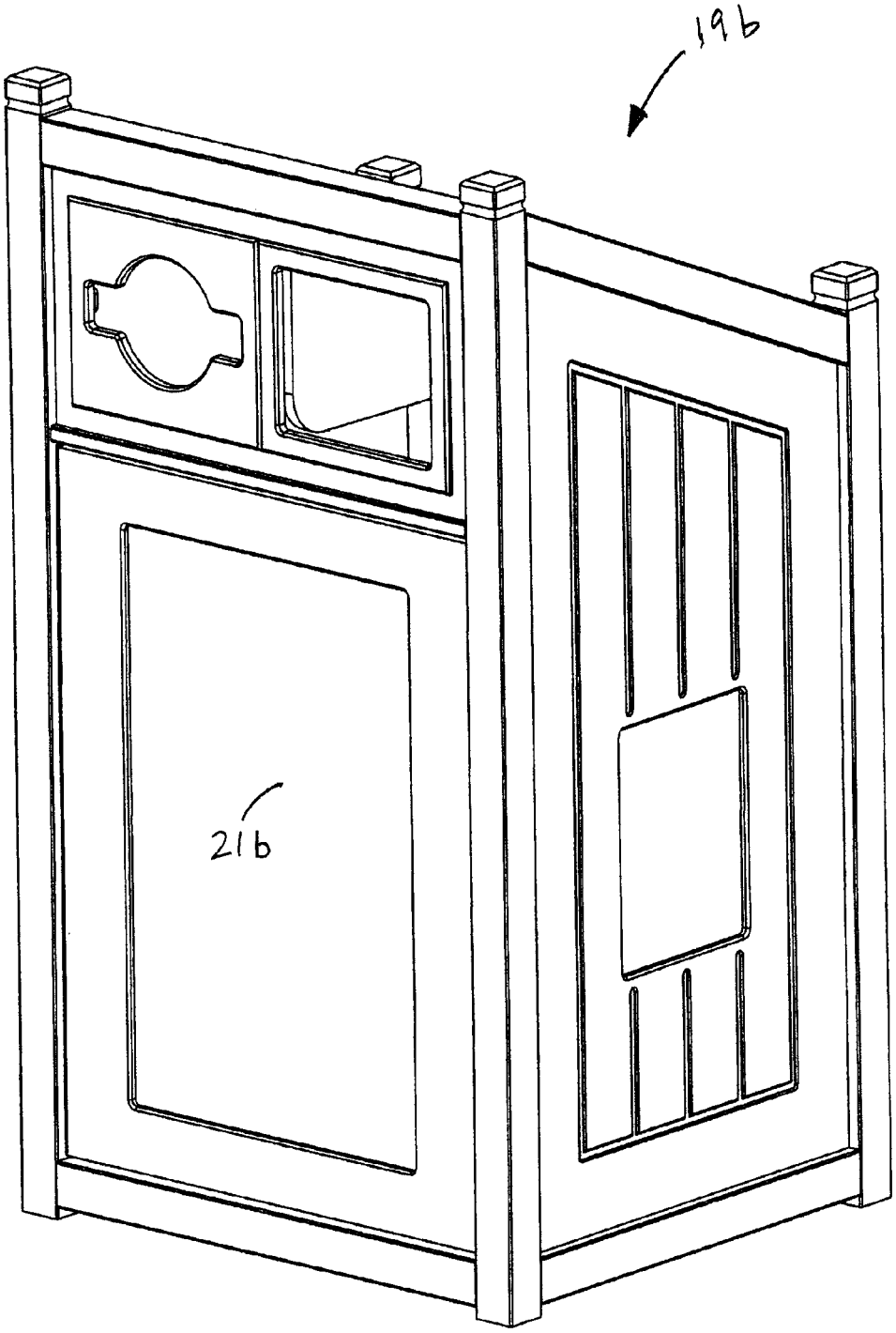
FIG. 5 is an isometric view of a receptacle system according to another embodiment of the invention comprising an exterior housing, a sign holder for releasably retaining interchangeable signs (not shown), and two removable, interchangeable, modular opening plates incorporated in a side (front) wall of the housing.
Figure 6:
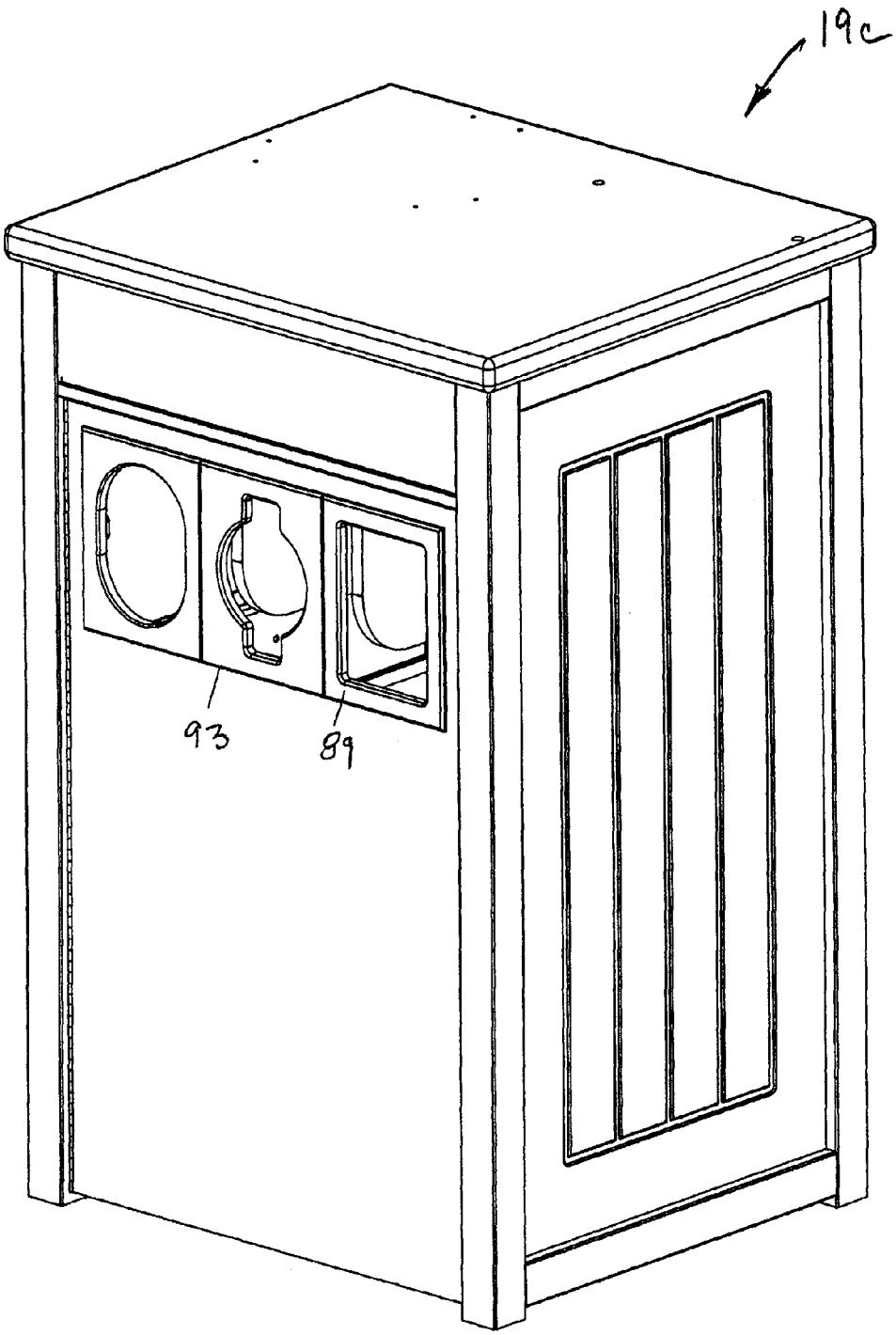
FIG. 6 is an isometric view of a receptacle system according to another embodiment of the invention comprising an exterior housing and three removable, interchangeable, modular opening plates incorporated in a side (front) wall of the housing.

In the case of "front-loading" systems, such as the systems shown in FIGS. 5 and 6, wherein the opening plates are positioned in a front wall of the housing, diverters (not shown) may also be used to channel waste/recycling from plate openings into corresponding compartments in the liner.

Further alternative embodiments of the invention will now be described with reference to FIGS. 21(*a-b*) to 37.

Figure 21A:
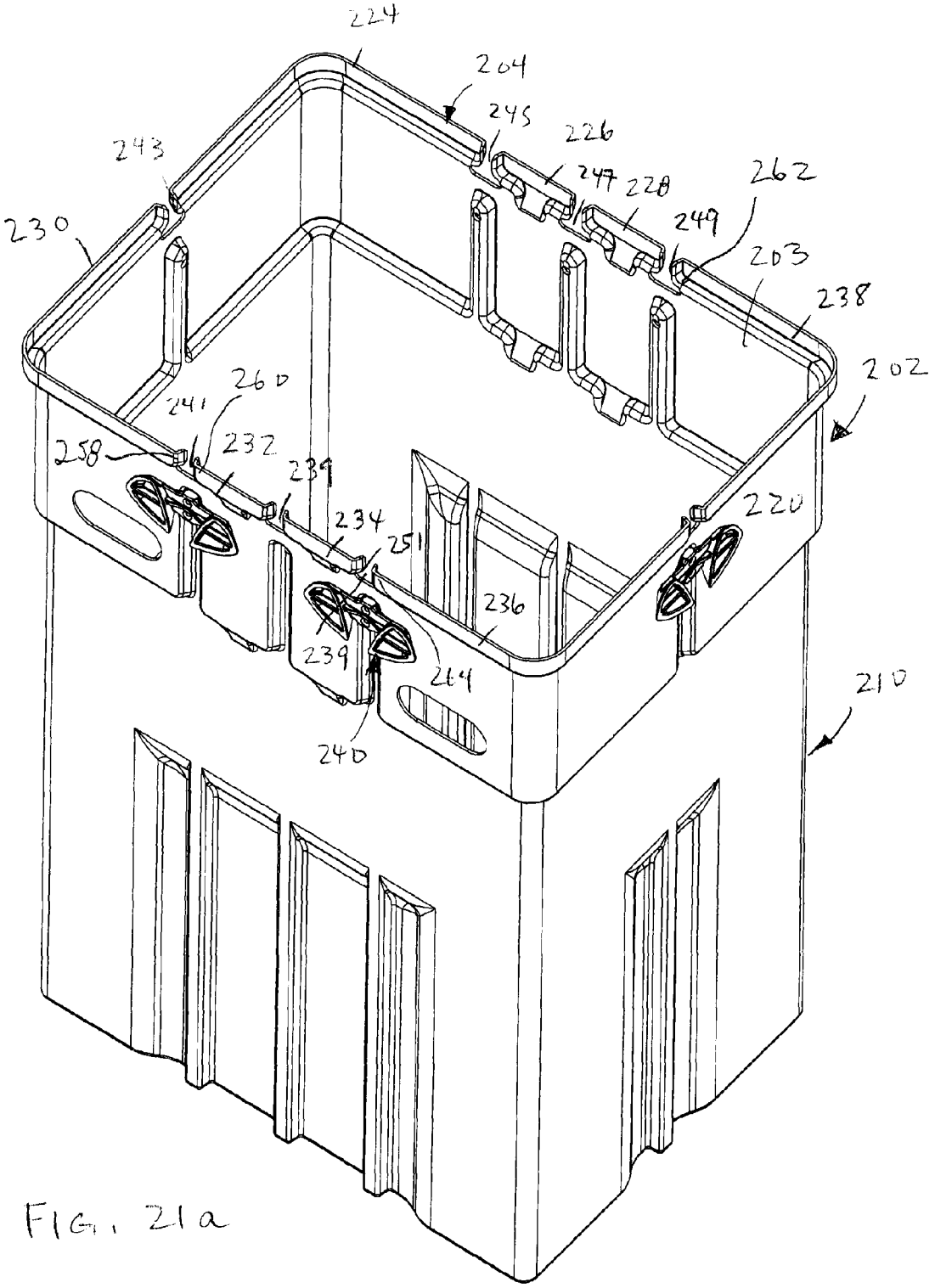
FIG. 21*a* is an isometric view of a receptacle assembly comprising a receptacle and bag retention system integrally formed with the receptacle.
Figure 21B:
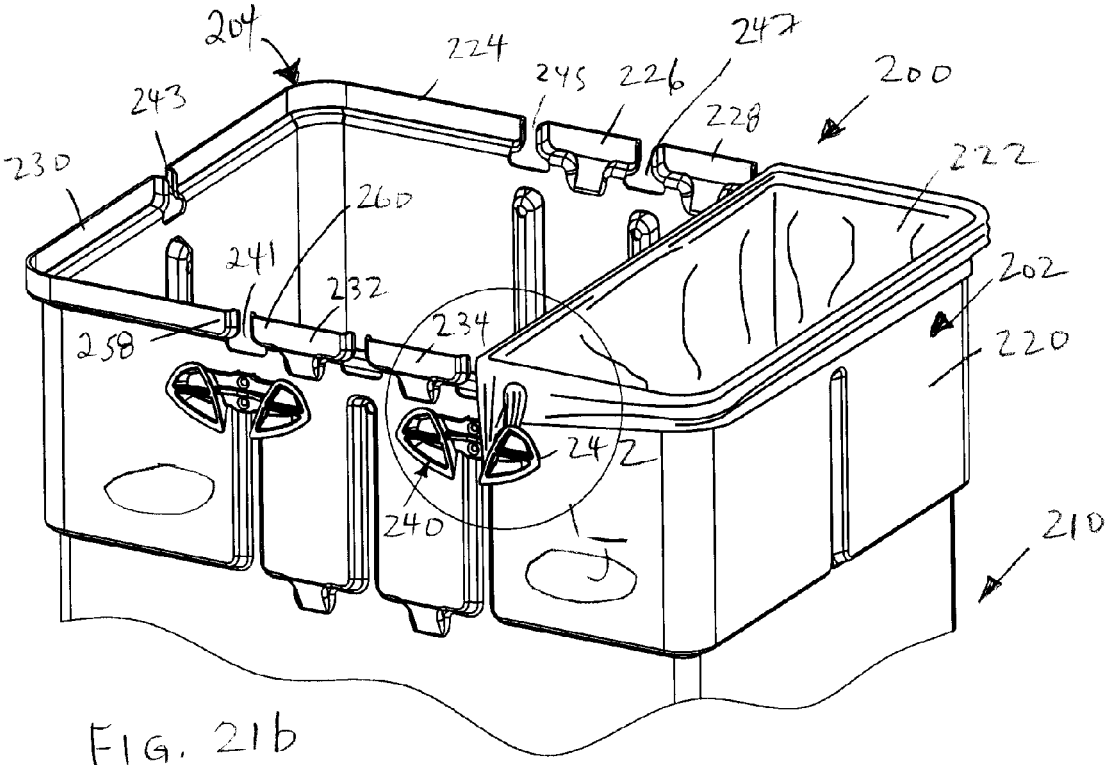
FIG. 21*b* is a partial isometric view of the receptacle assembly of FIG. 21*a* showing a bag mounted therein.
Figure 22:
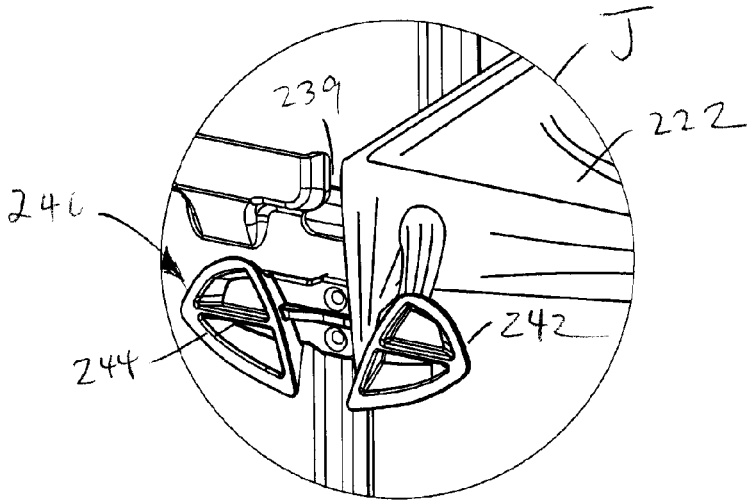
FIG. 22 is an enlarged view of the portion of FIG. 21*b*, designated by letter J in FIG. 21*b;*
Figure 23:
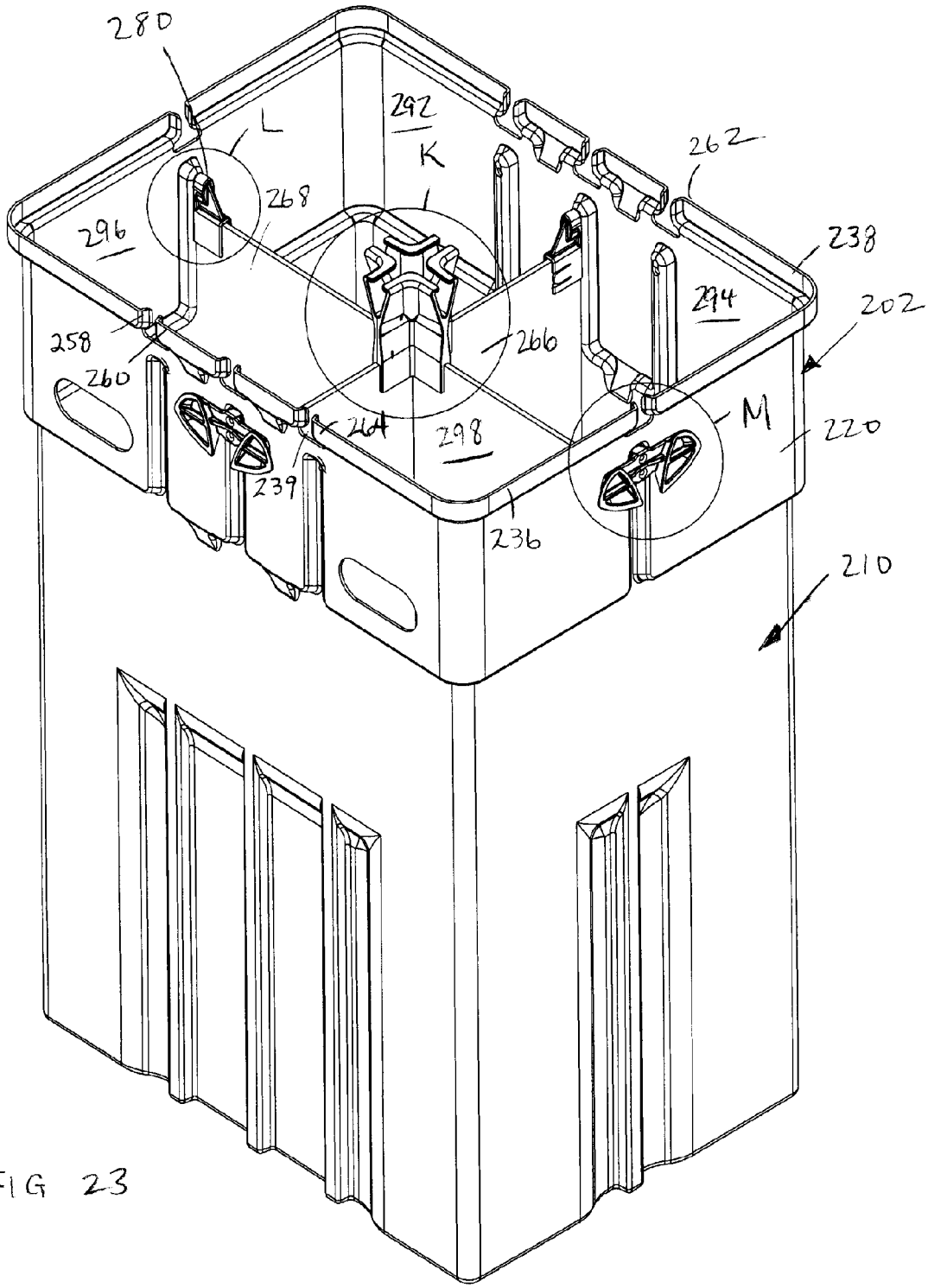
FIG. 23 is an isometric view of an assembly comprising the receptacle shown in FIGS. 1*a-f* in combination with two criss-crossing dividers and a rim retention system according to another embodiment of the invention.

FIGS. 21*a*, 21*b* and 22 show one embodiment of a receptacle assembly 200 comprising a bag retention system 202 that (in this embodiment) is integrally formed with a receptacle 210. In this embodiment, the bag retention system 202 has a peripheral side wall element 220 having an upper portion defining an opening 203 through which a plastic bag 222 can be received. In this embodiment, a bag opening and support member in the form of a rim 204 is formed at the top of the peripheral side wall element 220. The rim comprises a plurality of outwardly extending and spaced apart flanges, e.g. flanges 224, 226, 228, 230, 232, 232, 234. Adjacent flanges, e.g. flanges 232 and 234 define therebetween downwardly extending slots (e.g. slot 239).

As can be seen in a variety of figures including FIG. 21*a*, each slot (e.g. slots 241, 243, 245, 247, 249, 251) widens from the top to the bottom such that the flanges on either side of each slot define a pair of opposed overhangs, e.g. overhangs 258, 260.

The bag 222 is securely and releasably attached to the receptacle 210 by inserting it into the receptacle 210, folding an upper portion thereof over two flanges 236, 238 and overhangs 262, 264, pulling material from the upper portion of the bag 222 taut around the flanges 236, 238 and overhangs 262, 264, feeding excess bag material through the slot 239 and winding the excess material around one wing of a butterfly anchor 240 (shown enlarged in FIG. 22). The butterfly anchor 240 is located below the flange 236 and coupled to and extending outwardly from the peripheral side wall element 220 a distance such that the excess bag material can be held in place between the butterfly anchor and the side wall element 220 by frictional engagement between the anchor 240 and the side wall element 220. In this embodiment, the butterfly anchor 240 comprises two opposed wings 242, 244 (best seen in FIG. 22) and either or both wings can be used to secure the excess material depending on the amount of excess material.

In this embodiment, the flanges define four pairs of slots, with each pair of slots being located one on opposing sides of the peripheral side wall element 220. The bag retention system further comprises multiple butterfly anchors which cooperate with the flanges and slots to allow one or more bags of the same or different size to be mounted in different configurations within the receptacle 210. For example, a large bag can go over the entire rim 204 and fill the entire receptacle 210 and, in such case, all the flanges, one slot and one butterfly anchor will be used to maximize the opening to the interior of the bag and keep the bag tightly retained on the rim. Alternatively, three smaller bags, each of the size of the bag 222 shown in FIG. 21*b*, can be mounted in the receptacle in the manner described using opposing pairs of slots and overhangs, and flanges adjacent to those slots and overhangs, to form three separate compartments for receiving waste and different types of recycling. It will be appreciated that, depending on the size of the bag, different combinations of slots, overhangs and flanges can be used to retain the bag in the receptacle and that the bag need not necessarily be mounted using opposing pairs of slots and overhangs or at right angles or parallel to one another, though for a rectangular receptacle this would help to maximize storage capacity. As a further alternative, one small bag filling one third of the receptacle and one large bag filling two thirds of the receptacle can also be used. Because multiple bags can be mounted on the rim to provide multiple compartments, it is not necessary to include dividers in the receptacle assembly 200 and the receptacle assembly 200 can be used as shown in FIG. 21*a*. However, dividers can be included as an option as will now be described with reference to FIGS. 23 to 35.

Figure 24:
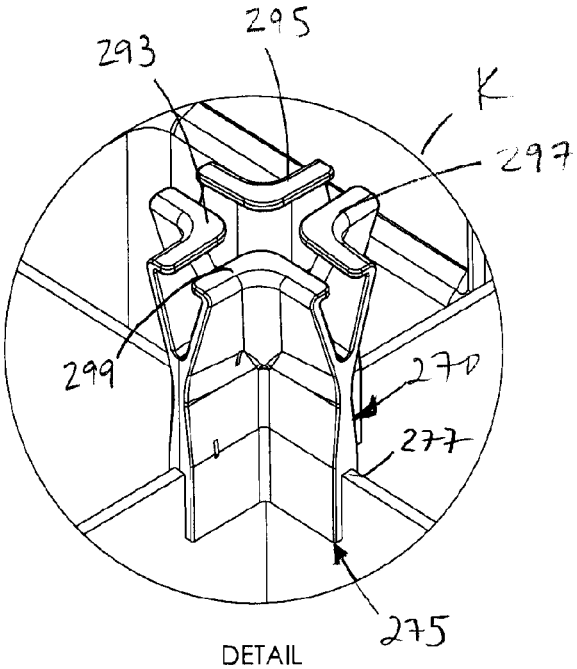
FIGS. 24, 25 and 26 are enlarged views of those portions of FIG. 23 designated by reference letters K, L, and M, respectively.
Figure 25:
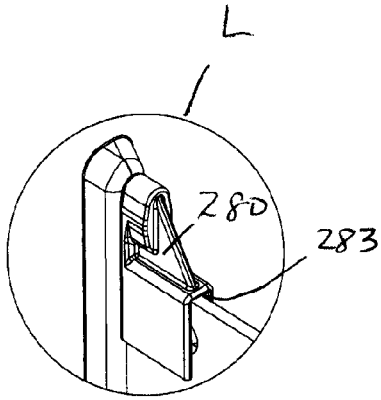
Figure 26:
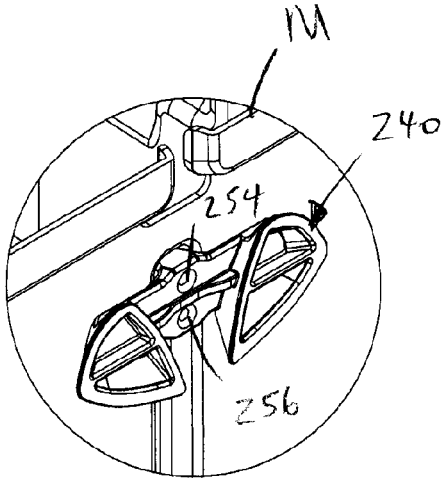

FIGS. 23, 24, 25 and 27 depict a configuration of the receptacle assembly according to another embodiment of the invention comprising the receptacle 210, bag retention system 202, two divider elements in the form of criss-crossing planar dividers 266, 268, for use in dividing the interior of the peripheral side wall element into four interior spaces (i.e. compartments 292, 294, 296, 298), a coupling system for releasably coupling the planar dividers 266, 268 together, and fastening means for fastening the planar dividers 266, 268 to the peripheral side wall element 220. The coupling system is designated by reference letter K in FIG. 23 and shown enlarged in FIG. 24. Referring to FIG. 24, the coupling system is in the form of a cross-shaped divider connector 270 for connecting the planar dividers 266, 268 together. Referring to FIG. 27, the divider 266 is fit over top the divider 268 using cooperating slits 272, 274. The divider connector 270 has a bottom 275 (FIG. 24) that defines a cross-shaped channeled receiver 277 sized and shaped to receive the top edges of the dividers 266, 268 and thereby maintain the dividers in a transverse relationship and to assist in securing them together to form a criss-cross divider assembly. Each divider 266, 268 has a bracket 276, 278, 280, 282 releasably attached to top corners thereof. Referring to FIG. 25, each bracket is provided with a channel 283 and a pin (not shown) that seats within the channel. The channel is sized and shaped to receive a top corner portion of the divider therein with the pin being received in a respective hole 284, 286, 288, 290 (shown in FIG. 27) in the top corner of the dividers 266, 268. The brackets 276, 278, 280, 282 are used to releasably couple the criss-cross assembly to the peripheral side wall element 220. In this embodiment, once the criss-cross assembly is inserted in the receptacle 210, with side edges of the dividers 266, 268 being slidably received in the internal grooves of the upstanding side wall and bottom wall of the receptacle 210, the brackets 276, 278, 280, 282 are aligned with holes in the side wall of the receptacle assembly and screws (not shown) are used to secure the brackets 276, 278, 280, 282 (which are inside the receptacle) to respective the butterfly anchors (which are on the outside of the receptacle). Referring to FIGS. 27, 28 and 29, the butterfly anchors each have a stud 246 that is press-fitted inside a hole (not shown) in the receptacle side wall and the screws are inserted through holes 254, 256 of the butterfly anchor 240, corresponding holes in the receptacle side wall, and corresponding openings 250, 252 in the corresponding bracket. It will be appreciated that when dividers and brackets are not employed, the butterfly anchors 240 can still be affixed to the side wall of the receptacle assembly by using bolt connectors to connect the butterfly anchors just to the side wall of the receptacle assembly.

Referring again to FIG. 24, the divider connector 270 comprises a top which is shaped and dimensioned to define four inwardly extending flanges 293, 295, 297, 299 that cooperate with and extend away from opposed corresponding flanges on the peripheral side wall element 220 of the bag retention system, whereby a bag can be inserted in one of the compartments 292, 294, 296, 298 and the upper portion can be folded over one of flanges 293, 295, 297, 299 in the T-shaped divider connector 270 that is located at one corner of the compartment and the flange or flanges on the rim at the perimeter of the same compartment. As in the case of the other examples, the upper portion of the bag can be pulled taut around the flanges and corresponding overhangs, and excess material fed through a suitable slot and secured using a butterfly anchor.

Figure 30:
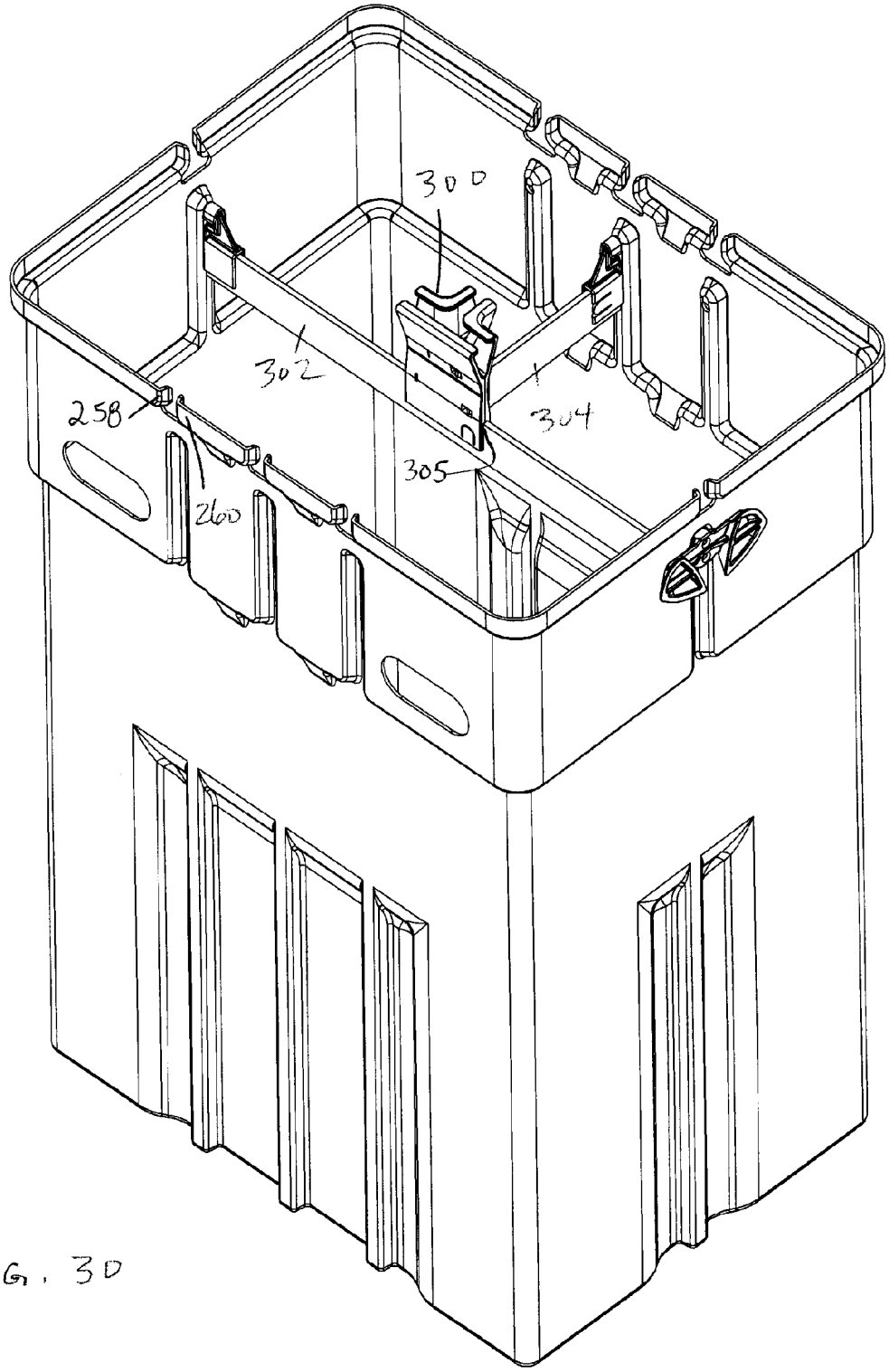
FIG. 30 is an isometric view of an assembly comprising the receptacle shown in FIGS. 1*a-f* in combination with a full and a half divider and a T-shaped divider connector according to additional embodiments.
Figure 34:
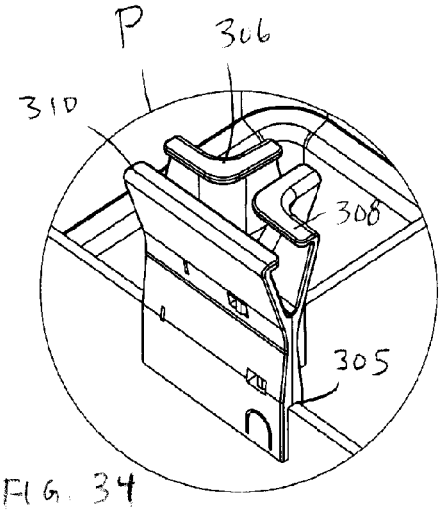
FIG. 34 is an enlarged view of the T-shaped divider connector designated by reference letter P in FIG. 33.
Figure 35:
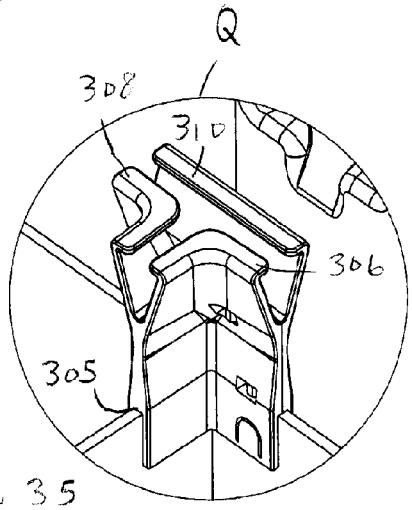
FIG. 35 is an enlarged view of an identical T-shaped divider connector shown from an opposite side and designated by reference letter Q in FIG. 33.

FIG. 30 shows a further embodiment of a receptacle assembly according to the invention which employs a T-shaped divider connector 300 (that is also shown in FIGS. 34 and 35) and divider elements in the form of a full divider bar 302 and a half divider bar 304. The T-shaped divider connector 300 has a three pronged channel 305 formed in a bottom wall thereof and which is sized and shaped to receive and frictionally engage the divider bars 302, 304 to connect them together in a transverse relationship. The divider connector 300 has a top portion that defines three inwardly extending flanges 306, 308, 310 that cooperate with opposing flanges on the rim of the receptacle assembly for use in mounting up to three bags in the manner described above.

As mentioned, FIGS. 31, 32, and 33 illustrate additional receptacle configurations that can be achieved by the present invention. In these embodiments, planar divider elements that extend to the bottom wall of the receptacle are employed. While not required, the divider elements facilitate bag removal as the each bag and its contents are confined in mutually exclusive spaces defined by the planar dividers and the bags do not touch each other.

Figure 36:
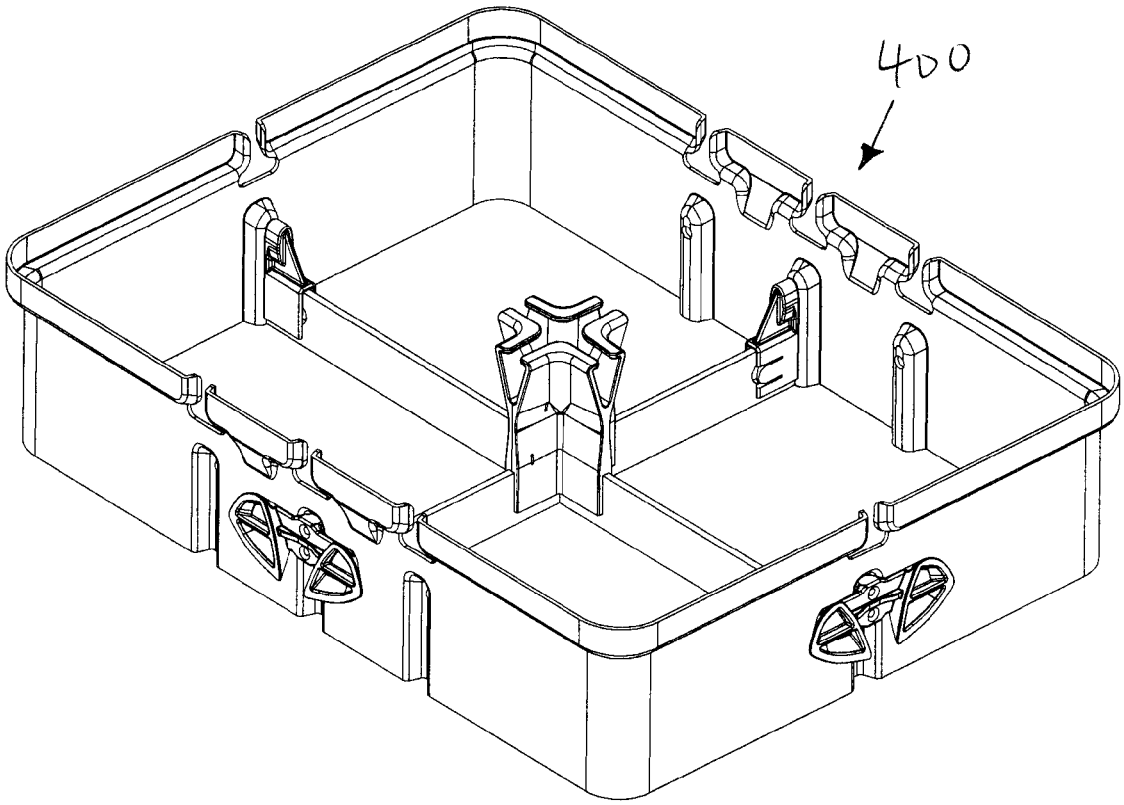
FIG. 36 is an isometric view of a bag retention system according to another embodiment which can be inserted inside an existing waste or recycling receptacle or housing.

FIG. 36 shows a bag retainer system 400 which can be mounted to a suitable support structure, e.g. a support rack or on top of a receptacle, using suitable fasteners. The bag retainer system 400 is effective in mounting bags thereon in the manner described and no external walls or internal dividers surrounding the mounted bags are required.

It will be appreciated that the foregoing description of the embodiments shown in the drawings is by way of example only and that numerous variations to these embodiments are possible. For example, in the case of all the described embodiments, the surfaces of the receptacle assembly (i.e. the flanges and overhangs) that engage the bag in a tight fashion are rounded to prevent tearing of plastic bags. For example, the overhangs and flanges have rounded outer surfaces and the overhangs are bent slightly inwardly. When bags that are not prone to tearing are used, e.g. cloth bags, it is not necessary for such surfaces to be rounded. Moreover, the size and shape of the flanges, slots, tensioning elements, compartments, receptacle, divider elements, divider connectors, exterior housing, opening plates, and plate openings can be varied. For example, the receptacle (e.g. liner) and/or exterior housing may be circular, hexagonal, octagonal, etc. in cross-section. In addition, variations can be made to the materials employed in fabricating components of the receptacle assembly and receptacle system. Thus, the foregoing description of the embodiments shall not be construed to limit the scope of the invention as defined by the following claims.

The invention claimed is:

1. A bag retention system for retaining one or more bags used for the temporary on-site storage of discarded matter, the bag retention system comprising two of said wings in opposing relationship to one another, a. a peripheral side wall element having an upper portion defining an opening for receiving at least one bag, the peripheral side wall element having a bag opening and support member about which an upper portion of a bag can be wrapped; and b. a tensioning element located below the bag opening and support member and coupled to and extending outwardly from the side wall element, the tensioning element having means for releasably securing excess material from an upper portion of a bag, the tensioning element comprising two wings in opposing relationship to one another, which are spaced a selected distance from the side wall element to allow the excess bag material to be wrapped around the wings and held in place by friction;

wherein the bag opening and support member is at least one flange that extends outwardly from the peripheral side wall element, whereby a bag can be inserted in the opening with an upper portion thereof folded and pulled taut over the bag opening and support member by releasably securing the excess material to the tensioning element.

2. The bag retention system of claim 1, wherein the tensioning element is releasably coupled to the side wall element.

3. The bag retention system of claim 1, wherein the flange is defined by the top portion of the peripheral side wall element.

4. The bag retention system of claim 3, comprising a plurality of said flanges, spaced apart from one another and wherein adjacent flanges define therebetween a downwardly extending slot, and wherein the tensioning element is located below the slot, whereby excess bag material can be guided through the slot and releasably secured to the tensioning element.

5. The bag retention system of claim 4, wherein each slot widens from top to bottom such that the flanges on either side of the slot define a pair of opposed overhangs, whereby an upper portion of a bag can be wrapped over and maintained in a taut condition over at least one flange and a pair of overhangs.

6. The bag retention system of claim 4, comprising at least one pair of said slots, the slots of each pair being located in the peripheral side wall element opposite to one another, each pair of said slots corresponding to at least one tensioning element that is located below a slot in the pair, whereby an upper portion of a bag can be wrapped over and maintained in a taut condition over a flange that defines the at least one pair of said slots by feeding excess material from the upper portion through at least one slot and securing the excess material to the at least one tensioning element.

7. The bag retention system of claim 1, further comprising:

a. at least one divider element for use in dividing the interior of the peripheral side wall element into multiple interior spaces, b. fastening means for releasably fastening the at least one divider element to the peripheral side wall element.

8. The bag retention system of claim 7, further comprising a coupling system adapted to couple the at least one divider to another divider.

9. The bag retention system of claim 7, wherein the fastening means is adapted to couple the divider to the peripheral side wall element and at least one tensioning element.

10. The bag retention system of claim 7, wherein the coupling system, comprises at least one divider connector comprising a bottom and a channel defined in the bottom dimensioned and shaped to receive top edges of multiple dividers to hold the multiple dividers together.

11. The bag retention system of claim 10, wherein each of the divider connectors comprises a top which is shaped and dimensioned to define at least one flange that cooperates with and extends away from at least one flange of the peripheral side wall, whereby a bag can be inserted in a divided interior space of the peripheral side wall between cooperating flanges and an upper portion of the bag and be wrapped around the cooperating flanges and maintained in a taut condition using at least one tensioning element.

12. The bag retention system of claim 1, wherein surfaces that come in contact with an upper portion of a bag to be wrapped over and maintained in a taut condition over the surfaces are rounded to prevent tearing when plastic bags are employed.

13. A receptacle for the temporary on-site storage of discarded matter comprising, a. a bottom wall and a peripheral upstanding side wall coupled to and extending upwardly from the bottom wall, and b. the bag retention system of claim 1, wherein the peripheral side wall of the bag retention system is rigidly coupled to the peripheral upstanding side wall of the receptacle.

14. The receptacle of claim 13, wherein the peripheral side wall of the bag retention system is integrally formed with the peripheral upstanding side wall of the receptacle.

15. A receptacle for the temporary on-site storage of discarded matter comprising, a. a bottom wall and a peripheral upstanding side wall coupled to and extending upwardly from the bottom wall, and b. the bag retention system of claim 10, wherein the peripheral side wall of the bag retention system is rigidly coupled to the peripheral upstanding side wall of the receptacle.

16. The receptacle of claim 15, wherein the at least one divider is dimensioned to extend to the bottom wall of the receptacle.

17. The receptacle of claim 16, wherein the upstanding side wall of the receptacle has an inner surface defining at least one vertically extending groove that is shaped and dimensioned to slidably receive a side edge of the at least one divider.

18. The receptacle of claim 16, wherein the bottom wall of the receptacle has an inner surface that defines at least one groove that is shaped and dimensioned to slidably receive a bottom edge of the at least one divider.

19. The receptacle of claim 16 further comprising at least one outwardly extending rib formed on at least one of the inner surface of the upstanding peripheral side wall and the inner surface of the peripheral side wall element, the at least one groove being sized and dimensioned to engage a side edge of a divider seated in said at least one groove.

20. The receptacle of claim 19, wherein the at least one groove and the at least one rib are aligned vertically.

21. A receptacle system comprising:

a. a receptacle according to claim 13; and b. a lid sized and shaped to cover an opening to the receptacle, the lid comprising at least one removable opening plate, each opening plate defining a plate opening through which discarded matter can be thrown into the receptacle.

22. The receptacle system of claim 21, comprising two or more of said opening plates, each opening plate corresponding to a compartment within the receptacle, the opening plates being sized, shaped and configured to fit together with each other.

23. The receptacle system of claim 21, wherein the lid further comprises diverters for channeling discarded matter from the plate openings to the corresponding compartments within the receptacle.

24. A receptacle system comprising:

a. a receptacle according to claim 13; and b. an exterior housing sized, shaped and configured to house the receptacle therein and comprising a top wall and a peripheral side wall coupled to and extending downwardly from the top wall, at least one of the top and peripherals side walls of the exterior housing comprising at least one removable opening plate, each opening plate defining a plate opening through which discarded matter can be thrown into the receptacle.

25. The receptacle system of claim 24, wherein the exterior housing comprises a sign holder and signage releasably retained in the sign holder, the signage displaying graphics showing a user what material is to be thrown into each plate opening.

26. The receptacle system of claim 24, comprising a plurality of said opening plates, each opening plate corresponding to a compartment within the receptacle, the opening plates being sized, shaped and configured to fit together with each other.

27. The receptacle system of claim 24, wherein the housing further comprises diverters for channeling discarded matter from the plate openings to the corresponding compartments within the receptacle.

* * * * *